US011897021B2

(12) United States Patent
Ross et al.

(10) Patent No.: US 11,897,021 B2
(45) Date of Patent: Feb. 13, 2024

(54) METALLIC CONTAINER WITH A THREADED CLOSURE

(71) Applicant: BALL CORPORATION, Broomfield, CO (US)

(72) Inventors: John R. Ross, Broomfield, CO (US); Anthony J. Scott, Westminster, CO (US); Howard C. Chasteen, Newport Richie, FL (US); Linda A. Hines, Westminster, CO (US)

(73) Assignee: BALL CORPORATION, Westminster, CO (US)

( * ) Notice: Subject to any disclaimer, the term of this patent is extended or adjusted under 35 U.S.C. 154(b) by 201 days.

(21) Appl. No.: 16/674,986

(22) Filed: Nov. 5, 2019

(65) Prior Publication Data

US 2020/0156139 A1 May 21, 2020

Related U.S. Application Data

(60) Provisional application No. 62/755,654, filed on Nov. 5, 2018.

(51) Int. Cl.
*B21D 51/26* (2006.01)
*B21H 3/04* (2006.01)
(Continued)

(52) U.S. Cl.
CPC ..... *B21D 51/2661* (2013.01); *B21D 51/263* (2013.01); *B21D 51/38* (2013.01);
(Continued)

(58) Field of Classification Search
CPC ..... B21D 51/2661; B21D 51/263; B21D 51/2615; B21D 51/2653; B21H 3/02;
(Continued)

(56) References Cited

U.S. PATENT DOCUMENTS 1,602,126 A 5/1923 Russell
2,026,304 A 12/1935 Florentine
(Continued)

FOREIGN PATENT DOCUMENTS

CA 2665477 5/2008
DE 2644387 4/1978
(Continued)

OTHER PUBLICATIONS

Extended Search Report for European Patent Application No. 20208217.8, dated Apr. 13, 2021 11 pages.
(Continued)

*Primary Examiner* — Adam J Eiseman
*Assistant Examiner* — Fred C Hammers
(74) *Attorney, Agent, or Firm* — Sheridan Ross P.C.

(57) ABSTRACT

The present invention relates generally to a container that may be sealed and reclosed with a threaded closure. More specifically, the present invention relates to methods of manufacturing a metallic container having an opening with inwardly facing threads. The threads are formed on the metallic container by pressing a neck portion of the metallic container against closure threads of a threaded closure which is inserted at least partially into the opening. The container threads may optionally be formed while the threaded closure is in tension. In this manner, after the container threads are formed, the closure threads can apply a force to the container threads such that the threaded closure is in tension. The container opening may be selectively sealed and reclosed with the threaded closure which releasably engages the container threads. Novel apparatus and methods of sealing metallic containers and forming threads on the metallic containers are also disclosed.

13 Claims, 11 Drawing Sheets

(51) Int. Cl.

| | |
|---|---|
| ***B65D 41/34*** | (2006.01) |
| ***B65D 41/40*** | (2006.01) |
| ***B65D 1/02*** | (2006.01) |
| ***B21H 3/02*** | (2006.01) |
| ***B21D 51/38*** | (2006.01) |
| ***B21D 51/50*** | (2006.01) |

(52) U.S. Cl.
CPC ..... *B21H 3/02* (2013.01); *B21H 3/046* (2013.01); *B65D 1/0246* (2013.01); *B65D 41/349* (2013.01); *B65D 41/405* (2013.01); *B21D 51/50* (2013.01); *B65D 2251/20* (2013.01); *B65D 2401/05* (2020.05)

(58) Field of Classification Search
CPC .... B21H 3/046; B65D 41/349; B65D 41/405; B65D 1/0246; B65D 2401/05; B65D 2251/20; B65D 2543/00296; B65D 2543/0099; B65D 43/0229; B65D 39/08
USPC ..... 413/4, 5, 6, 23, 36, 74, 75
See application file for complete search history.

(56) References Cited

U.S. PATENT DOCUMENTS 2,038,524 A 4/1936 Carvalho
2,102,666 A 12/1937 Annen
2,117,407 A * 5/1938 Davis ..... B65D 41/045 222/546
2,207,564 A 7/1940 Wackman
2,337,456 A 12/1943 Draper
2,505,641 A 4/1950 Howe
2,559,658 A 7/1951 Pottle
2,661,862 A 12/1953 Howe
2,769,293 A * 11/1956 Cox, Jr. ..... B65B 7/285 29/523
3,142,280 A 7/1964 William
3,338,775 A 8/1967 Down et al.
3,452,897 A * 7/1969 Anthony ..... B65D 7/38 413/4
3,550,832 A 12/1970 Fitzgerald
3,811,174 A 5/1974 Eichinger
3,812,646 A 5/1974 Baldyga et al.
3,817,420 A 6/1974 Heisler
3,979,015 A 9/1976 Arfert
4,007,851 A 2/1977 Walker
4,054,229 A 10/1977 Arfert
4,189,824 A * 2/1980 Dillon ..... B65D 39/084 29/243.517
4,333,584 A 6/1982 Gall
4,823,537 A 4/1989 Duke
4,880,131 A 11/1989 Gallagher et al.
5,016,775 A 5/1991 Buedenbender
5,078,290 A 1/1992 Ochs
5,138,858 A 8/1992 Johnson et al.
5,207,341 A 5/1993 Yeager
5,240,138 A 8/1993 Gallagher
5,293,765 A 3/1994 Nussbaum-Pogacnik
5,704,240 A * 1/1998 Jordan ..... B21D 51/2615 72/106
5,718,352 A 2/1998 Diekhoff et al.
5,755,130 A * 5/1998 Tung ..... B21D 51/2615 413/69
5,785,198 A 7/1998 Credle, Jr.
5,806,707 A 9/1998 Boehm et al.
5,822,843 A 10/1998 Diekhoff et al.
5,875,906 A 3/1999 Price et al.
6,010,026 A 1/2000 Diekhoff et al.
6,010,028 A 1/2000 Jordan et al.
6,032,829 A 3/2000 Geisinger et al.
6,102,225 A 8/2000 Lynn
6,123,212 A 9/2000 Russell et al.
6,206,222 B1 * 3/2001 Cudzik ..... B65D 1/165 413/15
6,301,766 B1 10/2001 Kollé
6,626,310 B2 9/2003 Taha
6,959,830 B1 11/2005 Kanou et al.
6,981,601 B2 1/2006 Laveault et al.
7,147,123 B2 12/2006 Yamashita
7,171,840 B2 2/2007 Kanou et al.
7,555,927 B2 7/2009 Hanafusa et al.
7,798,357 B2 9/2010 Hanafusa et al.
7,824,750 B2 11/2010 Takegoshi et al.
7,905,130 B2 3/2011 Marshall et al.
7,942,028 B2 5/2011 Gillest et al.
8,016,148 B2 9/2011 Walsh
8,037,728 B2 10/2011 Hosoi
8,037,734 B2 10/2011 Hanafusa et al.
8,091,402 B2 1/2012 Hanafusa et al.
8,132,439 B2 3/2012 Hanafusa et al.
8,356,722 B2 1/2013 Dubs et al.
8,360,266 B2 1/2013 Adams et al.
8,474,634 B1 7/2013 Branson et al.
8,496,131 B2 7/2013 Forrest et al.
8,505,350 B2 8/2013 Marshall et al.
8,613,369 B2 12/2013 Kitto
8,740,001 B2 6/2014 Hanafusa et al.
9,073,113 B2 7/2015 Nishimoto
9,227,748 B2 1/2016 Nakagawa et al.
9,265,287 B2 2/2016 Sims et al.
9,594,947 B1 3/2017 Kotagiri et al.
9,617,043 B2 4/2017 McGirr et al.
10,040,593 B2 8/2018 Ross et al.
10,518,940 B2 12/2019 Vanon et al.
10,875,684 B2 12/2020 Ross et al.
2005/0008458 A1 1/2005 Keech et al.
2005/0039416 A1 2/2005 Hidding
2005/0067365 A1 3/2005 Hanafusa et al.
2005/0115294 A1 * 6/2005 Kanou ..... B65D 1/0246 72/121
2007/0017089 A1 * 1/2007 Hosoi ..... B21D 51/2615 29/801
2007/0062952 A1 3/2007 Kobayashi et al.
2008/0011702 A1 1/2008 Walsh
2008/0017642 A1 1/2008 King
2008/0047922 A1 2/2008 Olson et al.
2010/0051576 A1 3/2010 Tran et al.
2010/0065528 A1 3/2010 Hanafusa et al.
2010/0326946 A1 12/2010 Hanafusa et al.
2011/0164948 A1 7/2011 Marshall et al.
2012/0031913 A1 2/2012 Moore et al.
2012/0269602 A1 10/2012 Hanafusa et al.
2013/0199017 A1 8/2013 Kurosawa et al.
2014/0116979 A1 5/2014 Dunwoody
2014/0263150 A1 9/2014 Robinson et al.
2014/0298641 A1 * 10/2014 Siles ..... C22C 1/00 29/527.6
2015/0013416 A1 1/2015 Hosoi
2015/0225107 A1 * 8/2015 Ross ..... B65D 39/08 413/4
2016/0340088 A1 11/2016 Olson et al.
2017/0073110 A1 3/2017 Campbell
2017/0267415 A1 9/2017 Olson et al.
2018/0044155 A1 2/2018 Ross et al.
2018/0134460 A1 5/2018 Ramsey
2019/0031388 A1 1/2019 Ross et al.
2019/0084728 A1 3/2019 Bonfoey et al.
2020/0165044 A1 5/2020 Shah et al.
2022/0009668 A1 1/2022 Ross et al.

FOREIGN PATENT DOCUMENTS

DE 3505426 3/1986
DE 20201342 5/2002
EP 0740971 11/1996
EP 0806345 11/1997
EP 2662295 11/2013
EP 2662296 11/2013
EP 2692657 2/2014
EP 2835188 2/2015
EP 2955131 12/2015
GB 714973 9/1954

(56) References Cited

FOREIGN PATENT DOCUMENTS

| | | | |
|---|---|---|---|
| GB | WO9420237 | * | 9/1994 |
| HU | 229285 | | 10/2013 |
| JP | S44-25510 | | 10/1969 |
| JP | S51-28374 | | 3/1976 |
| JP | S51-73557 | | 6/1976 |
| JP | S52-99181 | | 8/1977 |
| JP | S63-123606 | | 5/1988 |
| JP | H02-180159 | | 7/1990 |
| JP | 3025724 | | 6/1996 |
| JP | 2002-137032 | | 5/2002 |
| JP | 2002-302137 | | 10/2002 |
| JP | 2003-205924 | | 7/2003 |
| JP | 2004-210403 | | 7/2004 |
| JP | 2005-96843 | | 4/2005 |
| JP | 3665002 | | 6/2005 |
| JP | 2005-263230 | | 9/2005 |
| JP | 2005-280768 | | 10/2005 |
| JP | 4115133 | | 7/2008 |
| JP | 4159956 | | 10/2008 |
| JP | 4173388 | | 10/2008 |
| JP | 2008-279510 | | 11/2008 |
| JP | 2009-46189 | | 3/2009 |
| JP | 2010-036986 | | 2/2010 |
| JP | 2011-505302 | | 2/2011 |
| JP | 2011-116456 | | 6/2011 |
| JP | 4723762 | | 7/2011 |
| JP | 2012-192984 | | 10/2012 |
| JP | 5290569 | | 9/2013 |
| JP | 5323757 | | 10/2013 |
| JP | 2013-244996 | | 12/2013 |
| JP | 5597333 | | 10/2014 |
| JP | 5855233 | | 2/2016 |
| JP | 5887340 | | 3/2016 |
| RU | 2326033 | | 6/2008 |
| RU | 2522059 | | 7/2014 |
| RU | 2642231 | | 1/2018 |
| WO | WO 99/32363 | | 7/1999 |
| WO | WO 00/50311 | | 8/2000 |
| WO | WO 2009/115377 | | 9/2009 |
| WO | WO 2009/134132 | | 11/2009 |
| WO | WO 2010/117009 | | 10/2010 |
| WO | WO 2011/078057 | | 6/2011 |
| WO | WO 2012/133391 | | 10/2012 |
| WO | WO 2012/143322 | | 10/2012 |
| WO | WO 2012/144490 | | 10/2012 |
| WO | WO 2013/167478 | | 11/2013 |
| WO | WO 2013/167483 | | 11/2013 |
| WO | WO 2016/166112 | | 10/2016 |

OTHER PUBLICATIONS

International Preliminary Report on Patentability for International (PCT) Patent Application No. PCT/US2019/059888, dated May 20, 2021 8 pages.
Official Action for Canada Patent Application No. 2,938,867, dated Mar. 29, 2021 8 pages.
Official Action with English Translation for Japan Patent Application No. 2020-047680, dated Apr. 6, 2021 8 pages.
Notice of Allowance for Mexico Patent Application No. MX/a/2016/010182, dated Feb. 2, 2021 2 pages.
Official Action for U.S. Appl. No. 16/052,236, dated Mar. 16, 2021 13 pages.
U.S. Appl. No. 16/906,772, filed Jun. 19, 2020.
Intention to Grant for European Patent Application No. 15747015.4, dated May 12, 2020 7 pages.
Official Action with English Summary for Mexico Patent Application No. MX/a/2016/010182, dated Jul. 13, 2020 7 pages.
Official Action for U.S. Appl. No. 16/052,236, dated Jul. 21, 2020 6 pages Restriction Requirement.
Official Action for U.S. Appl. No. 16/052,236, dated Oct. 15, 2020 10 pages.
"Screw thread," retrieved from http://en.wikipedia.org/wii/Screw_thread, retrieved on Jan. 8, 2015, 17 pages.
"Electromagnetic forming," retrieved from http://en.wikipedia.org/wiki/Electromagnetic_forming, retrieved on Nov. 17, 2014, 4 pages.
International Search Report and Written Opinion for International (PCT) Patent Application No. PCT/US15/14840, dated Jun. 23, 2015, 12 pages.
International Preliminary Report on Patentability for International (PCT) Patent Application No. PCT/US2015/014840, dated Aug. 18, 2016 9 pages.
Official Action for Australian Patent Application No. 2015213747, dated May 24, 2018, 3 pages.
Official Action for Australia Patent Application No. 2015213747, dated Nov. 1, 2018 4 pages.
Notice of Acceptance for Australia Patent Application No. 2015213747, dated Feb. 25, 2019 4 pages.
Official Action for Canada Patent Application No. 2,938,867, dated Feb. 9, 2018 4 pages.
Official Action for Canada Patent Application No. 2,938,867, dated Jun. 12, 2019 7 pages.
Partial Supplementary Search Report for European Patent Application No. 15747015.4, dated Sep. 29, 2017 12 pages.
Extended Search Report for European Patent Application No. 15747015.4, dated Jan. 16, 2018 10 pages.
Intention to Grant for European Patent Application No. 15747015.4, dated Nov. 13, 2019 8 pages.
Official Action with English Translation for Japan Patent Application No. 2016-550581, dated Nov. 27, 2018 11 pages.
Official Action with English Translation for Japan Patent Application No. 2016-550581, dated Jun. 25, 2019 8 pages.
Official Action with English Translation for Japan Patent Application No. 2016-550581, dated Dec. 10, 2019 8 pages.
Official Action for Mexico Patent Application No. MX/a/2016/010182, dated Oct. 15, 2019 3 pages.
Official Action for U.S. Appl. No. 14/616,299, dated Jan. 11, 2017 8 pages Restriction Requirement.
Official Action for U.S. Appl. No. 14/616,299, dated May 18, 2017 14 pages Restriction Requirement.
Official Action for U.S. Appl. No. 14/616,299, dated Aug. 30, 2017 14 pages.
Official Action for U.S. Appl. No. 14/6161,299, dated Jan. 10, 2018 14 pages.
Notice of Allowance for U.S. Appl. No. 14/6161,299, dated Apr. 10, 2018 11 pages.
Official Action with English Translation for Brazil Patent Application No. BR112016018055-0, dated Feb. 18, 2020 5 pages.
Official Action for Canada Patent Application No. 2,938,867, dated Apr. 8, 2020 3 pages.
Decision to Grant for Japan Patent Application No. 2016-550581, dated Feb. 18, 2020 3 pages.
International Search Report and Written Opinion for International (PCT) Patent Application No. PCT/US19/59888, dated Feb. 25, 2020 11 pages.
Official Action for Canada Patent Application No. 2,938,867, dated Dec. 16, 2021 5 pages.
Official Action with English Translation for Japan Patent Application No. 2020-037680, dated Oct. 5, 2021 12 pages.
International Search Report and Written Opinion for International (PCT) Patent Application No. PCT/US2020/038640, dated Sep. 8, 2020 9 pages.
International Preliminary Report on Patentability for International (PCT) Patent Application No. PT/US2020/038640, dated Jan. 6, 2022 6 pages.
Notice of Allowance for U.S. Appl. No. 16/052,236, dated May 26, 2021 9 pages.
Official Action for U.S. Appl. No. 16/906,772, dated Feb. 2, 2022 14 pages.
Official Action with English Translation for Brazil Patent Application No. BR112016018055-0, dated May 16, 2022 6 pages.
Official Action for Australia Patent Application No. 2019374778, dated Feb. 25, 2022 3 pages.
Partial Supplementary Search Report for European Patent Application No. 19881482.4, dated Jul. 4, 2022 13 pages.
Official Action (English translation) for Japan Patent Application No. 2021-523917, dated May 24, 2022 2 pages.

(56) References Cited

OTHER PUBLICATIONS

Official Action with English Translation for Russia Patent Application No. 2021115804/05, dated Feb. 28, 2022.
Decision to Grant for Russia Patent Application No. 2021115804/05, dated May 23, 2022.
Notice of Allowance for U.S. Appl. No. 16/906,772, dated May 12, 2022 8 pages.
Notice of Allowance for Australia Patent Application No. 2019374778, dated Sep. 5, 2022, 4 pages.
Official Action for Canada Patent Application No. 3118298, dated Aug. 29, 2022, 3 pages.
Notice of Allowance (with English translation) for Japan Patent Application No. 2021-523917, dated Oct. 4, 2022, 5 pages.
Official Action for Brazil Patent Application No. BR112021008418-5, dated Jan. 17, 2023, 4 pages.
Extended European Search Report for European Patent Application No. 19881482.4, dated Dec. 5, 2022, 14 pages.

* cited by examiner

METALLIC CONTAINER WITH A THREADED CLOSURE

CROSS-REFERENCE TO RELATED APPLICATIONS

This application claims priority under 35 U.S.C. § 119(e) to U.S. Provisional Patent Application Ser. No. 62/755,654 filed Nov. 5, 2018, which is incorporated herein in its entirety by reference. This application is also related to U.S. patent application Ser. No. 14/616,299 and U.S. patent application Ser. No. 16/052,236 which are each incorporated herein by reference in their entirety.

FIELD OF THE INVENTION

The present invention relates generally to a container that may be sealed and reclosed with a threaded closure. More specifically, the present invention relates to a metallic container, a threaded closure, and an apparatus and method of manufacturing a metallic container having an opening with inwardly facing threads and a threaded closure. The opening of the metallic container may be closed and sealed and selectively reclosed with the threaded closure which releasably engages the threads of the metallic container.

BACKGROUND

Metallic and glass beverage bottles are generally sealed by closures that cannot be used to reclose or reseal the container. The lack of a closure that can be used to reclose and/or reseal a beverage container after the container is opened creates several problems. First, the contents of an opened container must be consumed quickly or the contents will go flat, spoil, oxidize, or be otherwise wasted. Second, opened containers may tip over and spill the contents, creating a mess and further waste. Finally, containers that are not equipped with a closure that can be re-used to reclose the container cannot generally be re-used, thus creating waste and environmental concerns.

Beverage bottles with external threads on a neck portion are known. However, bottles with external threads are expensive to produce, leak, and have a low dispense rates. In addition, the diameter of the bore of a bottle with external threads is limited by the internal pressure required for the product. Some products would benefit from a container with a larger diameter bore, but known closures used to seal containers with external threads are not able to prevent pressure induced blowout or failure of the seal on containers with large diameter bores and certain internal pressures. Further, drinking from containers with external threads can be uncomfortable, adversely affecting consumer satisfaction of the beverage.

Although metallic containers have many benefits, some prior art methods of sealing a metallic container do not achieve an adequate engagement between the metallic container and a closure. More specifically, some methods and apparatus for sealing a metallic container with a threaded closure do not account for the elastic nature of metal. Accordingly, after threads are formed in a metallic container, the container threads will spring back or move relative to threads of the threaded closure because of the elastic nature of the metal. In some instances, an upper surface of the metallic container, such as a curl, may be spaced from the closure. In addition, the container threads may move apart from the closure threads.

The movement of the metal of a metallic container after sealing with a threaded closure can cause several problems. More specifically, when the elastic nature of the metal of the metallic container is not accounted for during sealing with the threaded closure, the resulting movement or "spring back" of the metal may cause the threaded closure to only loosely engage threads of the metallic container. This can result in a loss of seal or accidental opening of the metallic container. The loose engagement of the threaded closure may also make it difficult to determine if someone has tampered with the metallic container. Because of this, a sealed metallic container may be discarded although it has not been tampered with creating unnecessary waste and cost. The loose engagement between the threaded closure and the metallic container may be observed by the ease with which the threaded closure can be rotated in a closing direction relative to the metallic container. For example, after sealing a metallic container with a threaded closure using one capping method it is possible to rotate the threaded closure more than 10° in a closing direction relative to the metallic container before the torque increases to 10 in-lb.

Accordingly, there is an unmet need for a metallic container and a threaded closure that are cost effective to produce, which have improved pressure resistance, and provide an enjoyable drinking experience to the consumer as well as improved systems and methods of sealing a metallic container with a threaded closure.

SUMMARY OF THE INVENTION

The present invention provides novel methods and apparatus of producing a new and useful resealable metallic container adapted to receive a novel threaded closure. In one aspect of the present invention, a metallic container is provided, the metallic container generally comprising a bottom portion, a sidewall portion, and a neck portion extending upwardly from the sidewall portion. The bottom portion of the metallic container may optionally include a dome. Further, threads are formed on at least a portion of the neck portion of the metallic container by pressing the container neck against closure threads of a threaded closure. An opening is positioned on an uppermost portion of the neck portion. Optionally, a finish with a predetermined shape is formed on the uppermost portion of the neck portion. The finish is adapted to be rigid and dimensionally consistent and may include one or more exterior, upper, and interior sealing surfaces. In one embodiment, the finish is a curl. In one embodiment, the curl extends outwardly from the neck portion. Although generally applicable to metal containers, the embodiments and various aspects of the present invention may be used and implemented on containers comprised of other materials, including glass, plastic, paper, and combinations thereof.

One aspect of the present invention is an apparatus to seal a metallic container with a threaded closure. The apparatus generally includes, but is not limited to, one or more of: (1) a first tool configured to apply a first force to the threaded closure positioned in an opening of the metallic container; and (2) a second tool configured to apply a second force to an exterior surface of a neck of the metallic container to form container threads on the neck. The first force from the first tool may elastically deform the threaded closure. When the first tool stops application of the first force to the threaded closure, the threaded closure can partially return to its original shape. The threaded closure optionally is formed of a metal or a plastic.

In one embodiment, the threaded closure generally comprises a closure body with an outer surface including closure threads. The closure threads are formed before the closure body is inserted into the metallic container. In another embodiment, the threaded closure includes an extension projecting from the closure body at an angle. The first force from the first tool is selected to alter the angle. In one embodiment, the first force alters the angle of the extension by between approximately 0.5° and approximately 10°. In another embodiment, the first force alters the angle by between approximately 3° and approximately 6°.

In one embodiment, the movement of the first and second tools and/or the timing of the application of the first and second forces is controlled by cams of the first and second tools that engage a cam follower of the apparatus.

In one embodiment, the metallic container includes a bottom portion, a sidewall portion, the neck extending upwardly from the sidewall portion, and the opening positioned opposite to the bottom portion. The neck of the metallic container is unthreaded when the threaded closure is initially positioned in the opening of the metallic container. In one embodiment, the metallic container includes a curl at an uppermost portion of the neck. The curl may extend outwardly from the exterior surface of the neck.

In one embodiment, the second tool comprises a thread roller configured to contact the exterior surface of the container neck to press the container neck against the closure threads. In another embodiment, the second tool is configured to form container threads that include peaks and inwardly oriented valleys on an exterior surface of the neck. The peaks project inwardly from an interior surface of the neck. The valleys generally correspond to the peaks. In one embodiment, the thread roller presses the container neck portion into a valley of the closure threads. Optionally, the closure threads extend at least 360° around the closure body. Accordingly, in one embodiment, the container threads extend at least 360° around the container neck.

In one embodiment, the second tool is configured to apply the second force while the first tool applies the first force. In this manner, the second tool applies the second force while the threaded closure is elastically deformed by the first force applied by the first tool. In one embodiment, the first tool is configured to apply the first force in a downward direction. Optionally, the first force can be between approximately 1 pound and approximately 300 pounds. In one embodiment, the first force is approximately 100 pounds. In one embodiment, the first tool is configured to stop application of the first force after the second tool forms the container threads The first force from the first tool is selected to push the closure threads of the threaded closure a predetermined distance toward the bottom portion of the metallic container. In one embodiment, the first force presses the threaded closure between approximately 0.005 inches and approximately 0.1 inches, or between approximately 0.005 inches and approximately 0.015 inches, toward the bottom portion of the metallic container.

The first tool can comprise a projection configured to apply the first force to a bottom portion of a chamber formed in the closure body. Accordingly, in one embodiment, the first tool applies the first force to a portion of the threaded closure inward of an interior diameter of the opening of the metallic container. In one embodiment, a portion of the first tool that applies the first force has a diameter that is less than the interior diameter of the opening of the metallic container. More specifically, the diameter of the portion of the first tool that applies the first force may be less than an interior diameter of a chamber formed in the threaded closure.

In one embodiment, the first tool is configured to apply the first force to the extension projecting outwardly from the closure body. Optionally, the capping tool can include a tapered flange extending outwardly from a body. Accordingly, in one embodiment, the first tool applies the first force to a portion of the threaded closure inward of an exterior diameter of the container curl. In one embodiment, a portion of the first tool that contacts the threaded closure has a diameter that is less than the interior diameter of the opening of the metallic container.

In one embodiment, after the second tool forms the container threads, the apparatus is operable to separate the first tool from the threaded closure such that the closure threads move away from the bottom portion of the metallic container. When the closure threads move away from the bottom portion, the closure threads can contact and apply a force to the container threads thereby placing the threaded closure in tension. More specifically, at least a portion of the closure body between the extension and an uppermost portion of the container threads will be in tension due to the force the closure threads apply to the container threads. In one embodiment, the closure threads move upwardly away from the bottom portion of the metallic container when the first tool is separated from the threaded closure. Additionally, or alternatively, the force applied to the container threads by the closure threads is directly upwardly away from the bottom portion of the metallic container. In one embodiment, the closure threads apply between approximately 1 pound and approximately 20 pounds of force to the container threads.

In one embodiment, when the first tool separates from the threaded closure, the extension exerts a biasing force on the closure body portion. The biasing force draws the closure body portion away from the bottom portion of the metallic container.

In one embodiment, when the first tool applies the first force, a distance between adjacent peaks of the closure threads may increase by between approximately 0.003 inches and approximately 0.015 inches. When the first force from the first tool is released, the distance between adjacent peaks of the closure threads may at least partially decrease. In one embodiment, the distance between adjacent closure thread peaks decreases by between approximately 0.001 inch and approximately 0.01 inches.

Another aspect of the present invention is a method of sealing a metallic container with a threaded closure. The method comprises one or more of: (1) providing the metallic container with a bottom portion, a sidewall portion, a neck portion extending upwardly from the sidewall portion, the neck portion being unthreaded, and an opening positioned on an uppermost portion of the neck portion; (2) providing a threaded closure including a closure body, closure threads formed on an outer surface of the closure body, and an extension projecting outwardly from the closure body; (3) positioning the threaded closure in the opening of the neck portion; (4) applying a first force to the threaded closure with a first tool; (5) applying a second force to an exterior surface of the neck portion with a second tool, the second force selected to press the neck portion against the closure threads to form threads on the metallic container; and (6) separating the first tool from the threaded closure to remove the first force such that the closure threads move away from the bottom portion of the metallic container and apply a force to the container threads thereby placing the threaded closure in tension. In this manner, the threaded closure seals a product within the metallic container. The first and second tools may be part of a capping apparatus of one embodiment disclosed herein.

In one embodiment, the first force causes elastic deformation in the threaded closure. When the first force is released after the container threads have been formed, a portion of the closure body between the extension and the closure threads (or an uppermost portion of the container threads) will be in tension. The tension is caused by movement of the closure threads away from the bottom portion of the metallic container.

In one embodiment, the first force is oriented generally downwardly toward the bottom portion of the metallic container. Accordingly, in one embodiment, applying the first force includes pushing the closure threads of the threaded closure a predetermined distance toward the bottom portion of the metallic container. In one embodiment, the first force presses the closure threads between approximately 0.005 inches and approximately 0.1 inches, or between approximately 0.005 inches and approximately 0.015 inches, toward the bottom portion of the metallic container.

Optionally, the first force may be oriented substantially transverse to the first force. More specifically, in one embodiment, the first force is oriented approximately parallel to a longitudinal axis of the metallic container. In another embodiment, the second force is oriented approximately perpendicular to the longitudinal axis.

In another embodiment, applying the first force comprises applying between approximately 1 pound and approximately 300 pounds of downward force the threaded closure. In one embodiment, the first force is approximately 100 pounds. Optionally, the method includes applying the second force by the second tool while the first tool applies the first force.

In one embodiment, the second tool can apply the second force while the first tool applies the first force. Additionally, or alternatively, applying the first force can include altering an angle at which the extension projects from the closure body. In one embodiment, when the first force is applied to the threaded closure, an outer portion of the extension bends away from a plane defined by a bottom portion of the threaded closure. The plane is oriented substantially perpendicular to a longitudinal axis of the threaded closure. In one embodiment, the first force alters an angle at which the extension projects from the closure body by between approximately 0.5° and approximately 10°. Optionally, the first force alters the angle by between approximately 3° and approximately 6°.

In one embodiment, the first tool comprises an interior tool configured to apply the first force to a bottom portion of a chamber formed in the closure body. Accordingly, in one embodiment, the first tool is configured to apply the first force to a portion of the closure body positioned inwardly of an interior diameter of the opening of the metallic container. In one embodiment, a portion of the first tool that applies the first force has a diameter that is less than the interior diameter of the opening of the metallic container.

Alternatively, the first tool can comprise a capping tool configured to apply the first force to the extension projecting outwardly from the closure body. The capping tool can apply the first force to a portion of the extension positioned inward of an outer diameter of a curl formed at an uppermost portion of the container neck portion. In one embodiment, a portion of the first tool that contacts the threaded closure has a diameter that is less than an outer diameter of the curl. In another embodiment, the diameter of the portion of the first tool that contacts the threaded closure is less than an interior diameter of the opening of the metallic container.

In one embodiment, the capping tool includes a tapered flange extending outwardly from a body. The tapered flange has a thickness that decreases as the distance from the longitudinal axis of the threaded closure increases. Accordingly, in one embodiment, the tapered flange has a first thickness and a second thickness at an outermost portion of the flange, the second thickness being less than the first thickness. In one embodiment, the body has a diameter that is less than the interior diameter of the container opening, or the diameter may be less than a diameter of a chamber formed in the threaded closure.

In one embodiment, the second tool is a thread roller. The second force from the thread roller forms container threads that include valleys that project inwardly from the exterior surface of the neck portion and peaks that project inwardly from an interior surface of the container neck portion. More specifically, the second force from the thread roller presses the container neck portion into a valley of the closure threads.

Still another aspect of the present invention is to provide a metallic bottle sealed with a threaded closure inserted into an opening of the metallic bottle, comprising: (1) the metallic bottle including a bottom portion, a sidewall portion extending upwardly from the bottom portion, a neck portion extending upwardly from the sidewall portion, container threads formed on at least a portion of the neck portion, the opening positioned on an uppermost portion of the neck portion, and a curl formed on the uppermost portion of the neck portion, the container threads including peaks that project inwardly from an interior surface of the neck portion, and an exterior surface of the neck portion including inwardly oriented valleys corresponding to the peaks; and (2) the threaded closure including a body portion positioned within the opening of the metallic bottle, the body portion including a bottom portion, a sidewall, an extension projecting outwardly from an upper portion of the sidewall, a tamper indicator that is interconnected to a portion of the extension, a chamber formed within the body portion, an opening to the chamber positioned opposite to the bottom portion, and threads formed on an exterior surface of the sidewall, the closure threads applying a force that is oriented upwardly to the container threads such that a portion of the closure body is in tension. In one embodiment, the portion of the closure body which is in tension is between the extension and the closure threads.

The extension can be configured to pull the closure threads away from the bottom portion of the metallic bottle. More specifically, in one embodiment, the extension exerts a biasing force on the body portion of the threaded closure. In this manner, the closure threads apply the upwardly oriented force to the container threads.

In one embodiment, before the container threads are formed the extension is angled downwardly toward a plane defined by the bottom portion of the closure body portion at a first angle. Optionally, the extension is angled downwardly between approximately 0.5° and approximately 10° before the container threads are formed. In another embodiment, after the container threads are formed, the extension bends upwardly away from the bottom portion of the closure body portion to a second angle that is less than the first angle.

Alternatively, in another embodiment, the extension is oriented outwardly approximately perpendicular to a longitudinal axis of the threaded closure. After the container threads are formed, the extension may be angled upwardly away from the bottom portion of the closure body portion.

In yet another embodiment, before the threaded closure is positioned within the container opening, the extension is angled upwardly away from the bottom portion of the closure body portion at a first angle. In this embodiment, after the container threads are formed, the extension is angled upwardly away from the bottom portion of the closure body portion at a second angle that is greater than the first angle.

In one embodiment, the threaded closure further comprises at least one channel formed through the closure threads formed on the closure body. The at least one channel is adapted to provide communication from an interior of the metallic bottle to ambient air when the threaded closure is rotated to remove the threaded closure from the opening of the metallic bottle. In this manner, the channel facilitates the release of pressure from within the metallic bottle before the closure threads lose thread engagement with the container threads to prevent unintended expulsion of the threaded closure from the opening of the metallic bottle.

The threaded closure can further comprise a recess formed in the closure extension, the recess configured to receive the bottle curl. In one embodiment, the bottle curl extends outwardly from the neck portion. Additionally, or alternatively, the extension can include an outer portion, a skirt that extends downwardly from the outer portion toward the bottom portion of the closure body portion, and a second recess formed on an interior portion of the skirt.

In one embodiment, the tamper indicator is formed separately from the threaded closure. Alternatively, the tamper indicator can optionally be integrally formed with the threaded closure. The tamper indicator can be mechanically engaged to the extension. More specifically, in one embodiment the tamper indicator includes a catch configured to engage the second recess formed on the skirt. The tamper indicator can optionally include an extension with an interior diameter that is less than an exterior diameter of the bottle curl.

In another embodiment, the tamper indicator of the threaded closure is altered after the closure body is at least partially removed from the container body. In one embodiment, the tamper indicator is interconnected to an upper portion of the threaded closure body. In another embodiment, the tamper indicator may comprise a ring interconnected to an upper circumference of the closure body by a serrated band. The serrated band is adapted to fracture when the closure body is rotated and the ring contacts the curl or other feature formed on the uppermost portion of the neck portion. After the serrated band fractures, the ring is retained on the neck portion of the metallic bottle.

In yet another embodiment of the present invention the tamper indicator comprises at least one of a shrink film, a wax, a plastic, a metallic foil, a paper material, or a paint applied to the threaded closure and the metallic bottle. The material of the tamper indicator must be at least partially damaged or compromised by a consumer before or during rotation of the threaded closure by a consumer to open the metallic bottle.

In one embodiment, the container threads extend at least 360° around the neck portion. Additionally, the closure threads may extend at least 360° around the closure body portion. The peaks of the container threads project inwardly into valleys of the closure threads.

Still another aspect of the present invention is a threaded closure configured to seal a product within a metallic container. The threaded closure includes one or more of, but is not limited to: (1) a body portion including a bottom portion, a sidewall, a chamber, and an opening to the chamber positioned opposite to the bottom portion; (2) threads formed on an exterior surface of the sidewall; (3) an extension projecting outwardly from the sidewall; and (4) a tamper indicator that is interconnected to the extension. In one embodiment, the threads extend at least 360° around the sidewall.

The extension can be angled relative to the body portion. For example, an outer portion of the extension can be closer to the bottom portion of the closure body than an inner portion of the extension. In this manner, a plane that is substantially perpendicular to a longitudinal axis of the threaded closure will contact the inner portion of the extension while the outer portion of the extension will be spaced a predetermined distance from the plane.

In one embodiment, the extension is configured to bend in response to a force received from a capping apparatus when the threaded closure is sealed to the metallic container. More specifically, the extension can project outwardly from the sidewall at a predetermined angle. The force received from the capping apparatus can elastically deform the metallic container and alter the angle of the extension relative to the sidewall. In one embodiment, the extension can bend between approximately 0.5° and approximately 10° in response to the force from the capping apparatus. In one embodiment, the force alters the angle of the extension by between approximately 3° and approximately 6°.

In one embodiment, the threaded closure includes a plug seal extending downwardly from the extension. The plug seal may be approximately parallel to the longitudinal axis of the threaded closure.

In another embodiment, the threaded closure includes a seal projection extending outwardly from the body portion. The seal projection can be integrally formed with the body portion. In one embodiment, the threaded closure with the seal projection does not include a plug seal.

Optionally, the threaded closure can include a recess within the extension, the recess configured to receive a curl of a metallic container. A lower surface of the extension can be tapered or radiused to guide the curl into the recess.

In one embodiment, the tamper indicator is mechanically engaged to the extension. More specifically, the tamper indicator can engage the threaded closure by a snap fit or mechanical engagement. Additionally, or alternatively, the tamper indicator can be retained by the threaded closure by a friction fit. A skirt can extend downwardly from the extension, the skirt including an inwardly facing groove. A catch of the tamper indicator can fit into the inwardly facing groove to mechanically engage the tamper indicator to the threaded closure. In another embodiment, the tamper indicator can be integrally formed with the extension. Regardless, the tamper indicator is configured to detach or separate from the threaded closure when the threaded closure is rotated in an opening direction. In this manner, the tamper indicator is retained on the neck portion of the metallic container. In one embodiment, a portion of the tamper indicator is configured to contact a curl of the metallic container when the threaded closure is rotated in the opening direction such that the tamper indicator separates from the threaded closure.

Another aspect is an apparatus operable to seal a metallic container with a threaded closure inserted into an opening of the metallic container. The threaded closure generally includes: a closure body, an outer surface including closure threads that project outwardly from the closure body, a chamber formed in the closure body, and an extension projecting outwardly from an upper end of the closure body at a predetermined angle. The metallic container can include a bottom portion, a sidewall portion, a neck extending upwardly from the sidewall portion, the neck being unthreaded, and the opening positioned opposite to the bottom portion. The apparatus generally comprises: (1) a first tool configured to move along a longitudinal axis of the metallic container and apply a first force downwardly to the threaded closure positioned in the opening of the metallic container; and (2) a second tool configured to apply a second force to an exterior surface of the neck of the metallic container to form container threads on the neck by pressing the neck against the closure threads.

The first force from the first tool is selected to elastically deform the threaded closure and alter the predetermined angle at which the extension projects from the closure body. In one embodiment, the first force alters the angle of the extension by between approximately 0.5° and approximately 10°.

In one embodiment, the first force can push the closure threads of the threaded closure a predetermined distance toward the bottom portion of the metallic container. For example, the closure threads may move between approximately 0.005 inches and approximately 0.1 inches, or between approximately 0.005 inches and approximately 0.015 inches, toward the bottom portion of the metallic container.

After the second tool forms the container threads, the first tool can be retracted from the threaded closure such that the closure threads move upwardly away from the bottom portion of the metallic container and apply a force to the container threads. Additionally, when the first tool is retracted and the first force is removed from the threaded closure, the extension can spring back at least partially to the predetermined angle. The upward movement of the closure threads places an upper portion of the closure body in tension. More specifically, in one embodiment, the upper portion of the closure body between the extension and the closure threads is in tension due to the upward movement of the closure threads. In one embodiment, the upper portion of the closure body that is in tension is above an uppermost portion of the container threads.

In one embodiment, the first tool comprises a projection configured to move into the chamber of the threaded closure and apply the first force to a bottom portion of the chamber. Accordingly, in one embodiment, the first tool includes a body adapted to fit into the chamber. The body has a diameter that is less than a diameter of the chamber.

Alternatively, the first tool is configured to apply the first force to the extension projecting from the closure body. In one embodiment, the extension of the threaded closure includes an outer portion that projects toward a bottom portion of the closure body. The first force bends the projection outer portion upwardly and away from the bottom portion. Optionally, the capping tool includes a tapered flange extending outwardly from a body.

Optionally, the first tool is configured to apply the first force of between approximately 10 pounds and approximately 300 pounds to the threaded closure. In one embodiment, the first force is between approximately 80 pounds and approximately 120 pounds, or approximately 100 pounds.

The second tool is operable to apply the second force at the same time or subsequent to the first tool applying the first force. The second tool can comprise a thread roller. The thread roller can be configured to apply the second force generally transverse to the longitudinal axis of the metallic container. In one embodiment, the second force is oriented approximately perpendicular to the longitudinal axis. The second tool is configured to form container threads that include peaks that project inwardly from an interior surface of the neck and inwardly oriented valleys on the exterior surface of the neck, the valleys generally corresponding to the peaks.

It is another aspect to provide a method of sealing a metallic container with a threaded closure, comprising: (1) providing the metallic container having a bottom portion, a sidewall portion, a neck portion extending upwardly from the sidewall portion, the neck portion being unthreaded, and an opening positioned on an uppermost portion of the neck portion; (2) providing the threaded closure including a closure body, a chamber formed in the closure body, closure threads formed on an outer surface of the closure body, and an extension projecting outwardly from an upper portion of the closure body; (3) positioning the threaded closure in the opening of the neck portion; (4) applying a first force downwardly to the threaded closure with a first tool such that the first force alters an angle at which the extension projects from the closure body and causes elastic deformation in the threaded closure; (5) applying a second force to an exterior surface of the neck portion with a second tool, the second force oriented substantially transverse to the first force, and the second force to press the neck portion against the closure threads to form threads on the metallic container; and (6) separating the first tool from the threaded closure to remove the first force. When the first tool is removed from the threaded closure, the closure threads move upwardly and away from the bottom portion of the metallic container and apply a force to the container threads thereby placing a portion of the threaded closure in tension. In this manner, the threaded closure seals a product within the metallic container.

The first force can be applied to a bottom portion of the chamber by a projection of the first tool. The projection is configured to extend into the chamber of the threaded closure. In one embodiment, the first tool has a diameter that is less than an interior diameter of the closure chamber.

Alternatively, the first force can be applied to the extension by a portion of the first tool that contacts the extension. In one embodiment, when the first force is applied to the threaded closure, an outer portion of the extension bends away from a plane defined by a bottom portion of the threaded closure. In one embodiment, the first force alters the angle of the extension by between approximately 0.5° and approximately 10°.

Additional features and advantages of embodiments of the present invention will become more readily apparent from the following discussion, particularly when taken together with the accompanying drawings.

Although generally referred to herein as "metallic container," "metallic bottle," "beverage container," "container," and/or "bottle," it should be appreciated that the current invention may be used with containers of any size or shape including, without limitation, beverage cans and beverage bottles. Accordingly, the term "container" is intended to cover containers of any type. Further, as will be appreciated by one of skill in the art, although the methods and apparatus of the present invention are generally related to metallic containers and metallic bottles, the methods and apparatus of the present invention are not limited to metallic containers and may be used to form containers of any material, including without limitation aluminum, steel, tin, plastic, glass, paper, or any combination thereof.

The term "threads" as used herein refers to any type of helical structure used to convert a rotational force to linear motion. Threads may be symmetric or asymmetric, of any predetermined size, shape, or pitch, and may have a clockwise or counter-clockwise wrap. Threads may be formed on straight or tapered portions of a metallic container or a threaded closure and the threads may comprise one or more leads. A thread can extend a least partially around a threaded closure or a metallic container. In one embodiment, the thread can extend at least 360° around a threaded closure or a metallic container. Optionally, the thread can extend at least two times around the threaded closure or the metallic container, or alternatively, less than 360°. Additionally, it will be appreciated by one of skill in the art, that both helical threads and lug threads may be used with metallic containers and threaded closures of the present invention.

The phrases "at least one," "one or more," and "and/or," as used herein, are open-ended expressions that are both conjunctive and disjunctive in operation. For example, each of the expressions "at least one of A, B and C," "at least one of A, B, or C," "one or more of A, B, and C," "one or more of A, B, or C" and "A, B, and/or C" means A alone, B alone, C alone, A and B together, A and C together, B and C together, or A, B and C together.

Unless otherwise indicated, all numbers expressing quantities, dimensions, conditions, and so forth used in the specification and claims are to be understood as being modified in all instances by the term "about." Accordingly, unless otherwise indicated, all numbers expressing quantities, dimensions, conditions, ratios, ranges, and so forth used in the specification and claims may be increased or decreased by approximately 5% to achieve satisfactory results. In addition, all ranges described herein may be reduced to any sub-range or portion of the range, or to any value within the range without deviating from the invention. Although various exemplary dimensions are provided to illustrate one exemplary embodiment of the present invention, it is expressly contemplated that dimensions of containers and threaded closures may be varied and still comport with the scope and spirit of the present invention.

The term "a" or "an" entity, as used herein, refers to one or more of that entity. As such, the terms "a" (or "an"), "one or more" and "at least one" can be used interchangeably herein.

The use of "including," "comprising," or "having" and variations thereof herein is meant to encompass the items listed thereafter and equivalents thereof as well as additional items. Accordingly, the terms "including," "comprising," or "having" and variations thereof can be used interchangeably herein.

It shall be understood that the term "means" as used herein shall be given its broadest possible interpretation in accordance with 35 U.S.C., Section 112(f). Accordingly, a claim incorporating the term "means" shall cover all structures, materials, or acts set forth herein, and all of the equivalents thereof. Further, the structures, materials, or acts and the equivalents thereof shall include all those described in the summary of the invention, brief description of the drawings, detailed description, abstract, and claims themselves.

The Summary of the Invention is neither intended nor should it be construed as being representative of the full extent and scope of the present invention. Moreover, references made herein to "the present invention" or aspects thereof should be understood to mean certain embodiments of the present invention and should not necessarily be construed as limiting all embodiments to a particular description. The present invention is set forth in various levels of detail in the Summary of the Invention as well as in the attached drawings and the Detailed Description and no limitation as to the scope of the present invention is intended by either the inclusion or non-inclusion of elements or components. Additional aspects of the present invention will become more readily apparent from the Detailed Description, particularly when taken together with the drawings.

BRIEF DESCRIPTION OF THE DRAWINGS

The accompanying drawings, which are incorporated herein and constitute a part of the specification, illustrate embodiments of the invention and together with the summary of the invention given above and the detailed description of the drawings given below serve to explain the principles of these embodiments. In certain instances, details that are not necessary for an understanding of the disclosure or that render other details difficult to perceive may have been omitted. It should be understood, of course, that the invention is not necessarily limited to the particular embodiments illustrated herein. For example, it is contemplated that various features and devices shown and/or described with respect to one embodiment, species or figure may be combined with or substituted for features or devices of other embodiments, species or figures regardless of whether or not such a combination or substitution is specifically shown or described herein. Additionally, it should be understood that the drawings are not necessarily to scale.

Figure 1:
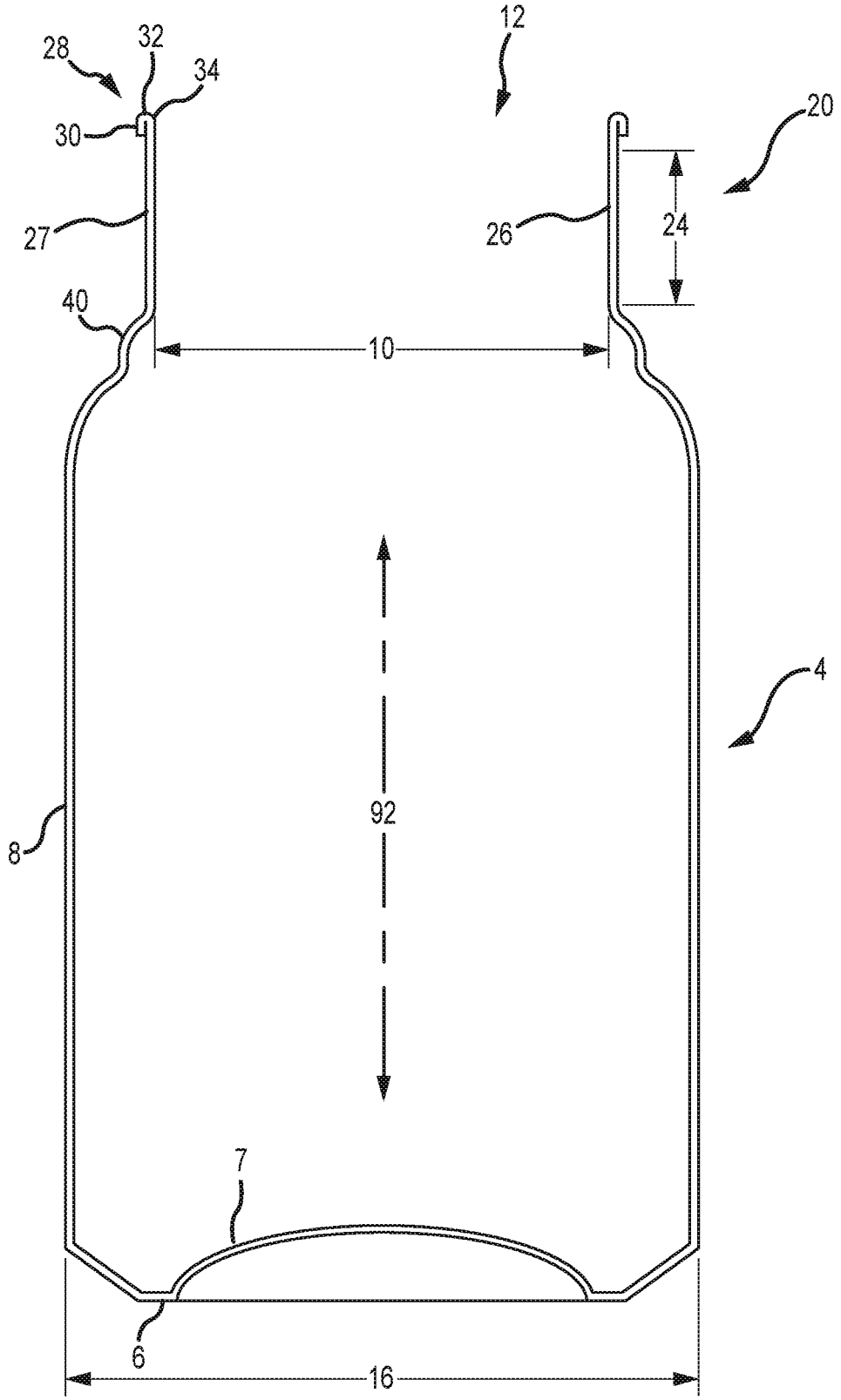
FIG. 1 is a cross-sectional front elevation view of a metallic container according to one embodiment of the present invention prior to threads being formed on the neck of the metallic container.
Figure 2A:
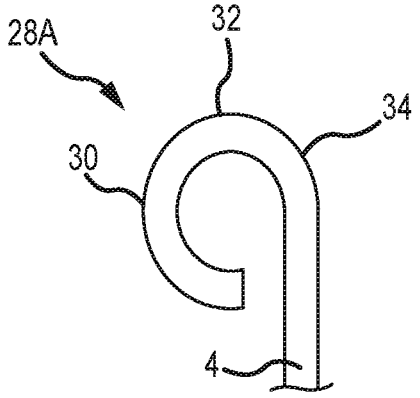
FIGS. 2A-2F are partially fragmented cross-sectional front elevation views depicting various configurations of an uppermost portion of a metallic container according to embodiments of the present invention.
Figure 2B:
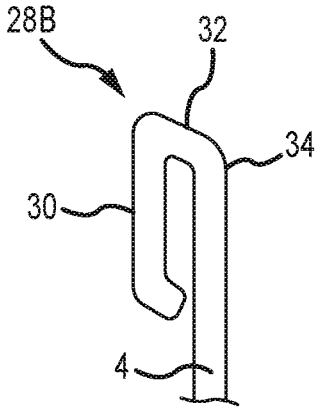
Figure 2C:
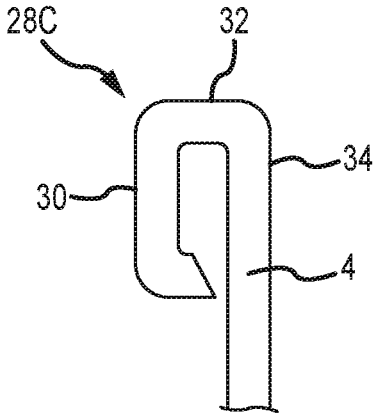
Figure 2D:
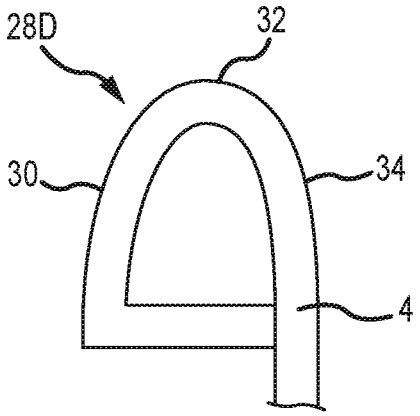
Figure 2E:
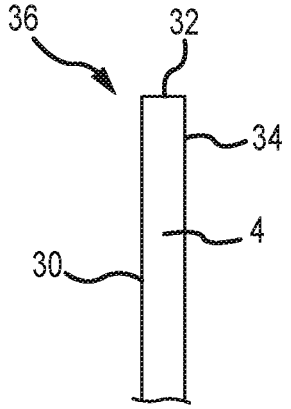
Figure 2F:
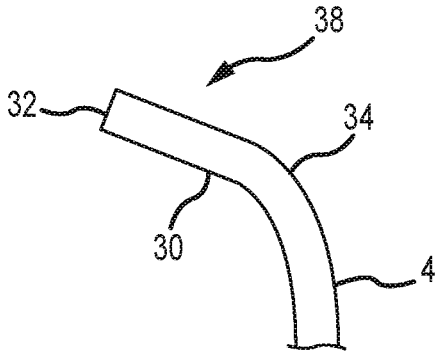

Similar components and/or features may have the same reference number. Components of the same type may be distinguished by a letter following the reference number. If only the reference number is used, the description is applicable to any one of the similar components having the same reference number.

A component list of the various components shown in drawings is provided herein:

| Number | Component |
|---|---|
| 4 | Metallic container |
| 6 | Bottom portion |
| 7 | Dome |
| 8 | Sidewall |
| 10 | Neck interior diameter |
| 12 | Bore or opening |
| 16 | Outer diameter |
| 18 | Height |
| 20 | Neck |
| 24 | Thread region |
| 26 | Inside surface of neck |
| 27 | Exterior surface of neck |
| 28 | Curl |
| 30 | Curl exterior surface |
| 32 | Curl upper surface |
| 34 | Curl interior surface |
| 36 | Straight trim |
| 38 | Flange |
| 40 | Stiffening bead |
| 41 | Lower surface of container threads |
| 42 | Container threads |
| 43 | Upper surface of closure threads |
| 44 | Closure |
| 45 | Lower surface of closure threads |
| 46 | Closure body |
| 47A | Closure thread peak |
| 47B | Container thread peak |
| 48A | Closure thread valley |
| 48B | Container thread valley |
| 49 | Opening |
| 51 | Interior surface |
| 52 | Chamber |
| 54 | Upper portion of closure body |
| 56 | Closure depth |
| 57 | Bottom portion |
| 58 | Exterior diameter of threads |
| 59 | Interior diameter of threads |
| 60 | Closure threads |
| 64 | Lug thread |
| 66 | Extension |
| 66A | Outer portion of extension |
| 66B | Inner portion of extension |
| 67 | Sidewall |
| 68 | Outer seal or alignment element |
| 69 | Buttress |
| 70 | Seal protrusion |
| 71 | Seal projection |
| 72 | Plug seal |
| 82 | Tamper indicator |
| 84 | Extension of tamper indicator |
| 86 | Serrated band |
| 87 | Axial serrations |
| 89 | Apparatus |
| 90 | Thread roller |
| 91 | Pilfer roller |
| 92 | Vertical axis |
| 93 | Pressure block |
| 94 | Chuck |
| 95 | Grip feature |
| 96 | Channels |
| 100 | Arrow indicating downward movement |

-continued

| Number | Component |
|---|---|
| 102 | Arrow indicating upward movement |
| 132 | Interior tool |
| 134 | End wall |
| 136 | Sidewall |
| 138 | Plane |
| 140 | Reference plane |
| 142 | Distance (Δy) |
| 144 | Distance |
| 146 | Angle of sidewall |
| 148 | Exterior surface of plug seal |
| 150 | Interior surface of plug seal |
| 152 | Capping tool |
| 154 | Body |
| 156 | Flange |
| 158 | Tapered surface |
| 160 | Skirt |
| 160A | Upper portion of skirt |
| 160B | Lower portion of skirt |
| 161 | Distance to skirt exterior |
| 162 | Recess |
| 164 | Lower surface |
| 166 | Hook or catch |
| 168 | Groove |
| 170 | Flange |
| 172 | Free end of extension |
| 174 | Distance between extension free end and curl |
| 176 | Distance between extension and container exterior surface |
| R1 | First radius of curvature |
| R2 | Second radius of curvature |

DETAILED DESCRIPTION

Various embodiments of the present invention are described herein and as depicted in the drawings. The present disclosure has significant benefits across a broad spectrum of endeavors. It is the applicant's intent that this specification and the claims appended hereto be accorded a breadth in keeping with the scope and spirit of the invention being disclosed despite what might appear to be limiting language imposed by the requirements of referring to the specific examples disclosed. It is expressly understood that although FIGS. 1-10 depict metallic containers and embodiments of an apparatus and methods of manufacturing metallic containers adapted to receive a threaded closure, the present invention is not limited to these embodiments and may be used with containers of any shape, size, or material.

Referring now to FIG. 1, a cross-sectional front elevation view of a metallic container 4 according to one embodiment of the present invention is illustrated prior to forming threads on the metallic container 4. The metallic container 4 has a bottom portion 6 and a sidewall portion 8. In one embodiment, the bottom portion 6 includes an optional inwardly oriented dome 7. A neck 20 extends upwardly from the sidewall portion 8. An opening or bore 12 is formed at an uppermost portion of the neck 20. The opening 12 is adapted to receive a threaded closure for selectively opening or closing the metallic container 4 after at least a portion of the neck 20 of the metallic container is threaded as described herein.

The metallic container 4 has been necked to a desired internal diameter 10 in a number of successive operations. Methods and apparatus used in necking metal containers are well known in the art as disclosed in U.S. Pat. No. 5,138,858 which is incorporated herein in its entirety by reference. In one embodiment, the interior diameter 10 of the opening 12 is between approximately 0.6 inches and approximately 6.0 inches prior to threading. In another embodiment, the interior diameter 10 is between approximately 0.8 inches and 2.2 inches prior to threading. In one embodiment, an outer diameter 16 of the metallic container 4 is between approximately 1.5 inches and approximately 8 inches. In a more preferred embodiment, the outer diameter 16 is between approximately 1.9 inches and approximately 3.1 inches.

The neck 20 has an interior surface 26 and a thread region 24 where threads are subsequently formed as described herein. The threads formed on the neck 20 are adapted to threadably engage threads formed on an exterior surface of a threaded closure inserted at least partially in the opening 12. The thread region 24 may have a cylindrical, tapered, or conic shape or combinations thereof, or any other desired shape.

A top edge of the metallic container 4 is trimmed to a desired length and formed into a finish with a predetermined shape to create seal surfaces which are rigid, smooth, and dimensionally consistent. In one embodiment, the predetermined shape of the finish is a curl 28. The curl 28 may comprise one or more folds of the material of the metallic container 4. The curl generally includes an exterior surface 30, upper surface 32, and interior surface 34 which are shown in FIG. 2. Optionally, in one embodiment, one or more stiffening beads 40 may be formed on the neck 20 during or after the necking.

Referring now to FIGS. 2A-2D, optional shapes of curls 28A, 28B, 28C, 28D are illustrated. In some embodiments, the curls 28 can extend outwardly away from the exterior surface of the neck. The curl 28 can have a straight or generally linear portion on one or more of the surfaces 30, 32, 34. Alternatively, one or more of the surfaces 30, 32, 34 of the curl 28 can be rounded. In one embodiment, curls 28A, 28B, 28C, or 28D may be formed of a material different than the material of the metallic container 4 interconnected to a straight trim 36 or a flange 38. In one embodiment, illustrated in FIG. 2E, the curl 28 is replaced by a straight trim 36 at the top edge of the metallic container 4. In still another embodiment, illustrated in FIG. 2F, optionally the curl 28 is replaced by a flange 38. It will be appreciated by one of skill in the art that the flange 38 can have any desired shape and may extend from the neck of the metallic container 4 at any desired angle.

Figure 3:
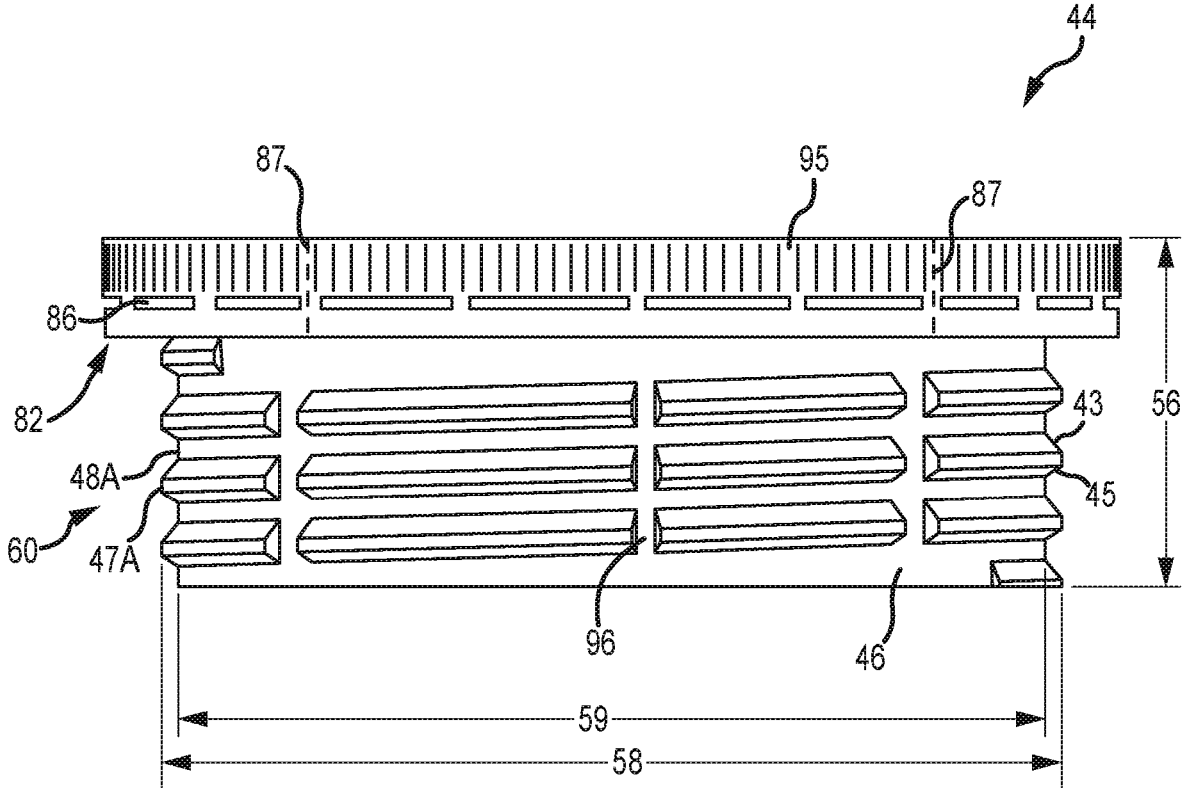
FIG. 3 is a front elevation view of a threaded closure according to one embodiment of the present invention.

Referring now to FIG. 3, a threaded closure 44 according to one embodiment of the present invention is generally illustrated. The threaded closure 44 may be formed of wood, cork, plastic, metal (including, without limitation, aluminum, steel, tin, or any combination thereof), a synthetic material, glass, paper, or combinations thereof. The threaded closure 44 has a body 46 with a predetermined depth 56. In one embodiment, the depth 56 of the body 46 is between approximately 0.5 inches and approximately 2.0 inches, but it will be appreciated by one of skill in the art that the depth 56 can be modified to be deeper or shallower based on the application.

Helical threads 60 are formed on an exterior surface of the body 46 of the threaded closure 44. More specifically, the closure threads 60 extend outwardly from the body 46. Accordingly, the closure threads 60 have an exterior diameter 58 that is greater than an exterior diameter of the closure body 46. The exterior diameter 58 of the closure threads is selected to fit into the unthreaded bore or opening 12 of a metallic container 4. In one embodiment, the exterior diameter 58 is between approximately 0.6 inches and approximately 4.0 inches. In another preferred embodiment, the exterior diameter 58 is between approximately 0.8 inches and approximately 2.2 inches. In yet another embodiment, the exterior diameter 58 is between approximately 1.1 inches and approximately 1.3 inches. Additionally, or alternatively, in one embodiment, the exterior diameter 58 at the upper-most portion of the closure threads 60 is greater than the exterior diameter 58 at the lower-most portion of closure threads 60. Accordingly, in one embodiment, the upper-most portion of the closure threads 60 has an exterior diameter 58 that is from about 0.0 inches to about 0.015 inches greater than the exterior diameter of the lower-most portion of the closure threads 60.

In one embodiment, the threads 60 have an interior diameter 59 of between approximately 0.6 inches and approximately 4.0 inches. In another embodiment, the interior diameter 59 is between approximately 0.8 inches and approximately 2.2 inches. In still another embodiment, the interior diameter 59 of the threads 60 is between approximately 1.05 inches and approximately 1.25 inches. It will be appreciated by one of skill in the art that the interior diameter 59 and the exterior diameter 58 of the closure threads 60 may be varied and still comport with the scope and spirit of the present disclosure.

The closure threads 60 have an upper surface 43, a lower surface 45, a peak 47, and a root or valley 48. In one embodiment, the closure threads 60 have a substantially symmetrical cross-sectional profile. In another embodiment, the cross-sectional profile of the closure threads 60 is not symmetric and the peak 47 of the closure threads 60 has a different profile than the valley 48 of the closure threads 60. In another embodiment, the upper surface 43 of the closure threads is substantially horizontal. In one embodiment, the closure threads 60 have more than one wrap around the body 46. In another embodiment, the closure threads 60 have between approximately 0.25 wraps to approximately 8 wraps around the body 46. In one embodiment, the threaded closure 44 includes a multi-lead thread formed of two or more individual threads. Each individual thread of the multi-lead thread can have a different number of thread wraps.

Optional channels 96 may be formed through the closure threads 60. The channels 96 provide communication between the interior of the metallic container 4 and a space between the container threads 42 and the closure threads 60. The channels 96 enable a controlled release of gas to release pressure from the interior of the metallic container 4 during removal of the threaded closure 44 by providing communication between the interior of the metallic container 4 and ambient air outside of the metallic container 4. After a seal between the metallic container 4 and the threaded closure 44 is broken, gas may escape through the channels 96 to the exterior of the metallic container 4 before the closure threads 60 lose thread engagement with threads 42 formed on the metallic container 4. This controlled release of pressure prevents the threaded closure 44 from being forcefully ejected from the metallic container 4 during opening and also allows for easy removal of the threaded closure 44. Moreover, the channels 96 prevent spitting or inadvertent upward release of product when the threaded closure 44 is removed from a metallic container 4 by allowing liquid product to drain downward out of the space between the container threads 42 and the closure threads 60. During handling, a filled metallic container 4 may be inverted allowing the liquid product to flow into the space between the threads 42, 60. When a metallic container 4 sealed by a threaded closure 44 without channels 96 is returned to a vertical position, the liquid product may not flow out of the space due to the surface tension of the liquid. If the liquid product remains in the space, the liquid product will block the path of the pressurized gas from the metallic container 4 when the metallic container 4 is opened. When a consumer rotates the threaded closure 44 to open the metallic container 4, the gas will push the residual liquid product trapped in the space between the threads 42, 60 out of the metallic container 4 and possibly onto the consumer. In contrast, when a metallic container 4 sealed by a threaded closure 44 with channels 96 is returned to a vertical position, the channels 96 form a path for the liquid product to flow downward back into the metallic container 4. When the threaded closure 44 is rotated, the channels 96 may also provide a path of least resistance for the escaping gas that is free of liquid product. In one embodiment, the channels 96 are substantially vertical. However, it will be appreciated by one of skill in the art that the channels 96 may have any orientation predetermined to form a path for the flow of liquid product downward into the metallic container 4 and to allow gas to escape when the metallic container is opened.

Optionally, a tamper indicator 82 may be formed on the threaded closure 44 to provide an indication to a consumer after the threaded closure 44 has been at least partially unthreaded from a metallic container 4. The tamper indicator 82 is adapted to be retained on a neck 20 of the metallic container 4 by separating from the threaded closure when the threaded closure 44 is rotated to open the metallic container 4. In one embodiment, the tamper indicator is interconnected to the threaded closure 44 by a score or a serrated band 86. In another embodiment, the tamper indicator 82 includes axial serrations 87 instead of the serrated band 86. When the threaded closure 44 is removed from a metallic container 4, the serrations 87 fracture and sections of the tamper indicator 82 flair outwardly to indicate that the threaded closure 44 has been at least partially removed from the metallic container 4. In one embodiment, the tamper indicator 82 is integrally formed of the same material as the closure body 46. Alternatively, the tamper indicator can optionally be formed separately from the closure body 46. In one embodiment, the tamper indicator 82 is interconnected to the threaded closure 44 and is formed of a metal or a plastic material that is different than the material of the closure body 46.

In one embodiment, the tamper indicator 82 comprises a zip strip formed of a scored material that must be pulled manually and at least partially and destructively removed from the threaded closure 44 before the threaded closure can be removed from the bore 12 of the metallic container 4. In one embodiment, the zip strip is formed of a material different than the material of the threaded closure 44. In another embodiment, the tamper indicator is a leash comprising a circumferential score or frangible band. As the consumer rotates the threaded closure to open the metallic container, the score is fractured. A first end of the leash is interconnected to a band retained on the neck 20 of the metallic container 4 and a second end of the leash is interconnected to the threaded closure 44 preventing loss of the threaded closure 44 and preventing the threaded closure from becoming litter.

Additionally, grip features 95 may optionally be formed on an exterior surface of the threaded closure 44 to improve a consumer's grip. In one embodiment, illustrated in FIG. 3, the grip features 95 comprise knurls. In another embodiment, the grip features may comprise one or more of knurls, scallops, holes, and slots formed on one or more exterior surfaces of the threaded closure 44. In one embodiment, the grip features 95 are formed by a pilfer roller, described below. Optionally, one or more surfaces of the threaded closure 44 may be decorated with a preferred indicia. In one embodiment, an exterior top surface (or public side) of the threaded closure is decorated. In another embodiment, an interior surface (or product side) of the threaded closure is decorated. In still another embodiment, the decoration comprises one or more of a lithographic image, an embossed image, and a debossed image.

Figure 4A:
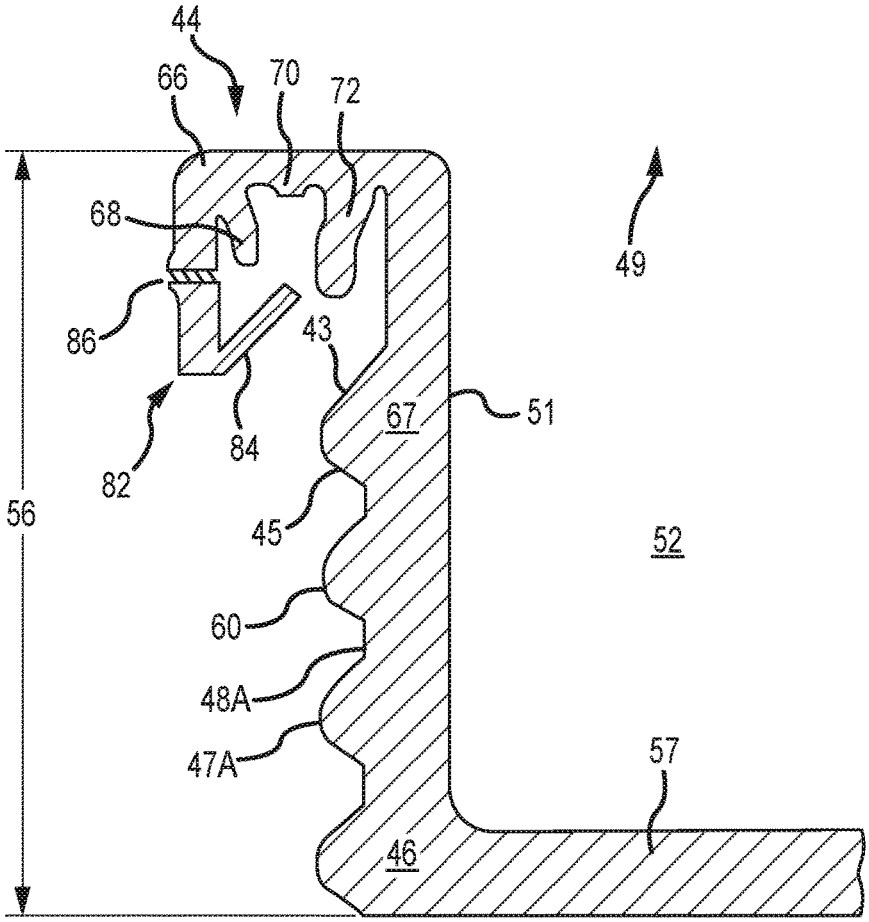
FIG. 4A is a partially fragmented cross-sectional front elevation view of a portion of a threaded closure according to one embodiment of the present invention.
Figure 4B:
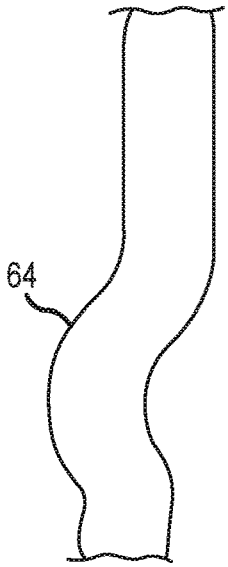
FIG. 4B is a partially fragmented cross-sectional front elevation view of an optional lug thread according to one embodiment of the present invention.

Referring now to FIG. 4A, a partially fragmented cross-sectional front elevation view of a threaded closure 44 according to one embodiment of the present invention is illustrated prior to insertion into the bore or opening 12 of a metallic container 4. The threaded closure 44 has helical threads 60; however, as will be appreciated by one of skill in the art, lug threads 64 may optionally be formed on the threaded closure 44 as illustrated in FIG. 4B.

The threaded closure 44 includes a bottom portion 57, a sidewall 67, and an optional chamber 52. The chamber 52 can be used to retain or store items of any type. For example, foodstuffs, liquids, gases, flavorings, prizes, cleaning materials, chemicals, beauty aids, tools, and other materials may be stored in the chamber 52. The chamber 52 is accessible by an upper opening 49. Optionally, the bottom portion 57 may be debossed or embossed to increase the rigidity of the threaded closure 44.

The body 46 of the threaded closure 44 may have a shape adapted to enable threaded closures 44 to be stacked to decrease the amount of space required to store the threaded closures 44. In one embodiment, the bottom portion 57 of the body 46 is adapted to at least partially fit into the chamber 52 of another threaded closure 44. In another embodiment, the bottom portion 57 at least partially fits into a deboss formed in the bottom portion 57 of another threaded closure 44.

The threaded closure 44 has an extension 66 extending outwardly from an upper circumference of the closure body 46. The extension 66 extends from the closure body 46 at a predetermined angle. In one embodiment, the extension 66 extends generally radially away from the closure body. One or more of an outer seal 68, a top seal 70, and an inner or plug seal 72 may be formed on the extension 66. The seals 68, 70, 72 can be sized and formed with a geometry adapted to contact and/or apply sealing forces to one or more of the surfaces 30, 32, 34 of a curl 28, a trim 36, or a flange 38 of a metallic container 4. Although illustrated in FIG. 4A extending from the extension 66, it will be appreciated by one of skill in the art that the plug seal 72 may extend directly from any predetermined location of the closure body 46. Further, the plug seal 72 may have any desired shape. Accordingly, in one embodiment, the plug seal 72 may be formed on, or extend from, the body 46 of the threaded closure 46. In another embodiment, the plug seal 72 is formed as a protrusion extending at least partially from the exterior surface of the body 46 of the threaded closure 44. In still another embodiment, the plug seal 72 is positioned above the closure threads 60. In yet another embodiment, the plug seal 72 may be positioned below the closure threads 60.

The outer seal 68, top seal 70, and plug seal 72 may be integrally formed on the threaded closure 44 or interconnected to the threaded closure. In one embodiment, the seals 68, 70, 72 may optionally be flexible or deformable to ensure sealing contact with the surfaces 30, 32, 34 of a curl 28. In another embodiment, the seals 68, 70, 72 may be made of or include a material that differs from a material of the body 46 of the threaded closure 44. For example, the seals 68, 70, 72 may include or be made of cork, rubber, plastic, elastomers, silicon, elastomeric material, or other flexible and/or compressible materials. Additionally, or alternatively, the top seal 70 may be designed to prevent damage to the curl 28 during shipping and handling of the filled metallic container 4. Accordingly, in one embodiment, the top seal 70 may be a bumper adapted to absorb a force applied to the threaded closure 44 to prevent unintended release of the seal between the metallic container 4 and the threaded closure 44.

Figure 5:
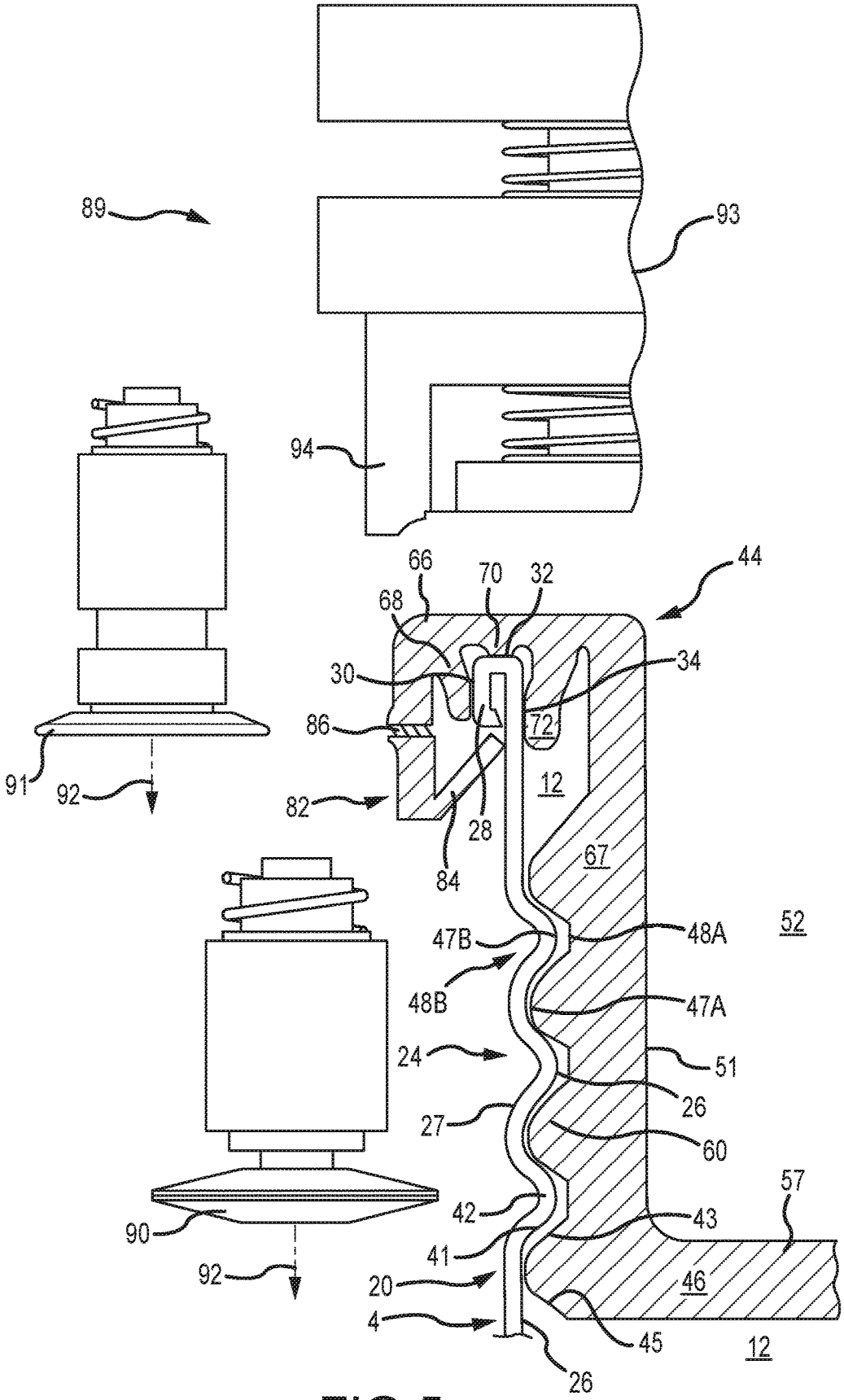
FIG. 5 illustrates a fragmented front elevation view of an apparatus operable to seal the metallic container of FIG. 1 with the threaded closure of FIG. 4A according to one embodiment of the present invention.

A tamper indicator 82 of one embodiment is formed on the extension 66. In one embodiment, the tamper indicator 82 includes an extension 84. The extension 84 can extend inwardly. Accordingly, an interior diameter of the extension 84 can be less than an exterior diameter of the extension 66. In one embodiment, the extension 84 is flexible. In this manner, the tamper indicator 82 can slide downwardly over a curl 28, a trim 36, or a flange 38 of a metallic container 4 when the threaded closure 44 is inserted into the bore 12 of the metallic container 4, as illustrated in FIG. 5.

Optionally, the opening 49 of the closure chamber 52 can be sealed by an optional cover. The cover keeps the chamber 52 sanitary and free of contamination. The cover may be made of paper, cardboard, metallic foil, or plastic, or combinations thereof. The cover may be interconnected to the threaded closure 44 by induction or any other method. In one embodiment, the cover is interconnected to the threaded closure 44 before the threaded closure is inserted into an opening of a metallic bottle 4. Alternatively, the cover can be interconnected to the threaded closure after bottle threads are formed on the metallic bottle 4. In one embodiment, the cover is hingedly interconnected to the threaded closure 44 and the cover may be lifted to allow access to the chamber 52 and lowered to reseal or reclose the chamber 52. In another embodiment, a portion of the cover is permanently interconnected to the threaded closure 44 to retain the cover to the threaded closure 44 to prevent litter. Optionally, the chamber 52 may have an uncovered opening 49.

Threaded closures 44 of all embodiments of the present invention may optionally include gas permeation barriers. The gas permeation barrier prevents $CO_2$ and/or $O_2$ from migrating through the body 46 of threaded closure. For example, some materials used to form the threaded closure may be at least partially permeable to $CO_2$ and $O_2$. In one embodiment, the gas permeation barrier comprises a material that is injected into a portion of the body 46 when the threaded closure 44 is formed. Additionally, or alternatively, the gas permeation barrier may be formed by a material that is applied to at least one of the interior and the exterior surfaces of the body 46 of the threaded closure 44. Regardless, the gas permeation barrier can increase the shelf-life of a product sealed in the metallic container 4 by increasing the amount of time required for the product to go flat or become oxidized.

The gas permeation barriers may be formed of any material that creates a barrier to keep $O_2$ out of, and $CO_2$ in, the interior of a metallic container 4. In one embodiment of the present invention, the gas permeation barrier is a silicon oxide material applied using a plasma coating process. In another embodiment, gas permeation barrier is a liquid that is applied to the threaded closure 44. In yet another embodiment, gas permeation barrier is a film applied to the threaded closure 44. In still another embodiment, the gas permeation barrier may be formed of a silicon oxide material. In one embodiment, the material of the gas permeation barrier scavenges or absorbs $CO_2$ and/or $O_2$.

Referring now to FIG. 5, a partial view of an apparatus 89 operable to seal a metallic container 4 with a threaded closure 44 is generally illustrated according to embodiments of the present invention. Although not illustrated, it will be understood that the right side of the apparatus 89 may be substantially symmetrical to the left side of the apparatus. The apparatus 89 generally includes one or more of a thread roller 90, a pressure block 93, and optionally, a pilfer roller 91.

The thread rollers 90 and pilfer rollers 91 can rotate about a vertical axis 92. The thread rollers 90 are loaded with a relatively light spring load and can traverse along the vertical axis 92 to move vertically up and down. In one embodiment, the spring load of the thread rollers 90 is less than about 3 pounds. The pilfer rollers 91 are generally loaded with a heavy spring. In one embodiment, the spring load may be 30 lbs. and the pilfer rollers 91 can traverse less than approximately 0.2 inches. In another embodiment, the pilfer rollers 91 do not traverse along the vertical axis 92.

The rollers 90, 91 are operable to rotate around the exterior of the metallic container 4 and apply a compressive force to predetermined portions of the metallic container 4 and the threaded closure 44. The rollers 90, 91 may be made of metal, rubber, plastic, or any other durable material known to those of skill in the art and can be of any shape or size and have contact surfaces of any profile. In one embodiment, two or more thread rollers 90 with contact surfaces of different profiles or sizes may be used to create the container threads 42. In another embodiment, the pilfer roller 91 is operable to form serrations in one or more portions of the threaded closure 44. Although only one thread roller 90 and one pilfer roller 91 are illustrated in FIG. 5, in one embodiment the apparatus 89 may include two or more thread rollers 90 and two or more pilfer rollers 91.

In one embodiment, the pressure block 93 includes a chuck 94 operable to press the threaded closure 44 downwardly into the bore 12 of the metallic container 4. In one embodiment, the check 94 is configured to hold the threaded closure 44. The chuck 94 may also rotate the threaded closure 44. The apparatus 89 may also include a second chuck (not illustrated) to support the metallic container 4 and hold the metallic container 4 in a predetermined position. Additionally, or alternatively, the apparatus 89 may include one or more of an interior tool 132 and a capping tool 152 described herein.

The movement and operation of the components of the apparatus 89 can be controlled by mechanical linkages which are not shown for clarity. For example, in one embodiment, the movement and timing of the pressure block 93 is controlled by the interaction of a cam with a cam follower. Additionally, or alternatively, the movement of the chuck 94, the thread roller 90, and the pilfer roller 91 may be controlled by a cam engaged with a cam follower. Suitable systems and methods of controlling the components of the apparatus 89 are known to those of skill in the art.

In one embodiment, a machine cam drives a capping head downward onto the metallic container. The thread roller and the pilfer roller may be interconnected to the capping head. As the capping head applies a top load or a first force, an internal spring loaded mechanism of the capping head will compress. As the capping head compresses, a cam internal to the capping head (an internal cam) forces one or more of the thread roller and the pilfer roller into operation.

In one embodiment, the capping apparatus includes only one machine cam and only one internal cam. Alternatively, in another embodiment, the capping apparatus 89 includes two or more machine cams. Each load or force applied by the capping apparatus can be actuated by its own machine cam. In this embodiment, the machine cam does not include an internal cam.

In operation, after the metallic container 4 is filled with a beverage, the apparatus 89 places the body 46 of the threaded closure 44 at least partially within the bore or opening 12 of the metallic container 4. In one embodiment, before the threaded closure 44 is placed in the bore 12, the metallic container 4 has an unthreaded thread region 24 that is generally cylindrical. One or more thread rollers 90 of the apparatus 89 can be positioned in contact with an exterior surface 27 of the thread region 24 of the container neck 20. Container threads 42 are formed on the metallic container 4 by the thread rollers 90 as the material of the thread region 24 is compressed between contact surfaces of the thread rollers 90 and the closure threads 60 of the threaded closure 44. In one embodiment, the thread rollers 90 generally start at the top of the thread region 24 of the metallic container 4 and work downwardly around the thread region 24.

During the threading of the metallic container 4, a top-load may optionally be applied to the threaded closure 44 by the pressure block 93 and/or the chuck 94. The top-load compresses the closure extension 66 between the container curl 28 and the pressure block 93.

Optionally, in one embodiment, the apparatus 89 is configured to rotate one or more of the metallic container 4 and the threaded closure 44 in a closing direction after the container threads 42 have been at least partially formed. In this manner, the closure body 46 can be driven further into the container bore 12 and the closure extension 66 is pressed against the container curl 28. Rotating the threaded closure 44 and/or the metallic container 4 in the closing direction also can create tension between the closure threads 60 and the closure extension 66 and makes the threaded closure 44 tight to the metallic container 4. More specifically, rotating the threaded closure 44 and/or the metallic container 4 in the closuring direction can improve the seal between the threaded closure and the metallic container.

In one embodiment, the apparatus 89 is configured to rotate one or more of the metallic container 4 and the threaded closure 44 in the closing direction until the torque increases to between approximately 3 in-lbs. and approximately 28 in-lbs, and more preferably approximately 10 in-lbs. In another embodiment, the apparatus 89 can rotate the metallic container 4 and/or the threaded closure 44 up to approximately 60° in the closing direction. In still another embodiment, the apparatus can rotate one or more of the metallic container and the threaded closure in a closing direction by between approximately 1° and approximately 180°.

The container threads 42 generally include peaks 47B that project inwardly from an interior surface 26 of the container neck 20. The peaks 47B of the container threads 42 project at least partially into valleys 48A of the closure threads 60. The exterior surface 27 of the container neck 20 includes valleys 48B that are inwardly oriented. The valleys 48B on the container neck 20 correspond to the container thread peaks 47B. Accordingly, in one embodiment, the container neck 20 has an undulating cross-section in the thread region 24 with the thread valleys 48B extending inwardly from a plane defined by an unthreaded portion of the container neck. In one embodiment, an exterior surface of each container thread valley 48B can be generally parallel to a surface of a corresponding container thread peak 47B.

When formed, in one embodiment the geometry of the container threads 42 generally corresponds to the geometry of the closure threads 60. In one embodiment, the container threads 42 have between approximately 0.25 wraps to approximately 8 wraps around the container neck 20. For example, in one embodiment, a container thread 42 can extend at least approximately 90° around the container neck. The container thread 42 can optionally extend less than 720°, or less than 450°. In one embodiment, the container threads 42 comprise a multi-lead thread formed of two or more individual threads. Each individual thread of the multi-lead thread can have a different number of thread wraps around the container neck 20.

In one embodiment, as the threads 42 are formed, the height of the metallic container 4 is decreased as the upper surface 32 of the curl 28 is drawn downwardly toward the bottom of the metallic container 4. The thread rollers 90 and the pilfer roller 91 are configured to rotate around the exterior surface 27 of the container neck 20. In one embodiment, the thread rollers 90 begin forming the container threads by pressing against a portion of the neck 20 proximate to the curl 28. The threads rollers 90 then spiral downwardly around the neck while applying a sideload force to the container neck. In another embodiment, the thread rollers 90 start at the bottom of the thread region 24 and work upwardly.

Methods and apparatus used to thread metal containers are disclosed in the following publications which are all incorporated herein in their entirety by reference: U.S. Patent Application Publication 2018/0044155, U.S. Patent Application Publication No. 2014/0263150, U.S. Patent Application Publication No. 2012/0269602, U.S. Patent Application Publication No. 2010/0065528, U.S. Patent Application Publication No. 2010/0326946, U.S. Pat. Nos. 8,132,439, 8,091,402, 8,037,734, 8,037,728, 7,798,357, 7,555,927, 7,824,750, 7,171,840, 7,147,123, 6,959,830, International Application No. PCT/JP2010/072688 (PCT Pub WO 2011/078057), and PCT Pub. WO 2018/031617.

When the threaded closure 44 is inserted into the opening or bore 12 of a metallic bottle 4, the pressure from the product within the metallic bottle 4 pushes the threaded closure 44 upward. The upper surface 43 of the closure threads 60 is pushed against and applies a force to a lower surface 41 of the container threads 42 and prevents unintended ejection of the threaded closure 44. In one embodiment (not illustrated), the upper surface 43 of the closure threads 60 and the lower surface 41 of the container threads 42 are substantially horizontal. The substantially horizontal surfaces 41, 43 improve the strength of the thread engagement between the closure threads 60 and the container threads 42 because the upward force of the upper surface 43 of the closure threads 60 is oriented substantially perpendicular to the lower surface 41 of the container threads 42.

As illustrated in FIG. 5, the threaded closure 44 may include a tamper indicator 82 interconnected to the extension 66 of the closure body 46. In one embodiment, the tamper indicator 82 includes a serrated band 86. The tamper indicator 82 may have other configurations. In one embodiment, the tamper indicator 82 has a flexible extension 84 that enables the tamper indicator 82 to slide downward over the curl 28 of the metallic container 4 when the threaded closure 44 is inserted into the bore 12 of the metallic container 4 by the apparatus 89. In one embodiment, the serrated band 86 is formed before the threaded closure 44 is inserted into the bore 12 of the metallic container 4. In another embodiment, the serrated band 86 is formed by tools of the apparatus 89 after the threaded closure 44 is inserted into the bore 12 of the metallic container 4.

After the metallic container 4 is sealed with the threaded closure 44, when a rotational force is applied to the threaded closure 44 to unthread the threaded closure 44 from the metallic container 4, the extension 84 of the tamper indicator 82 contacts a bottom surface of the curl 28, or another surface formed on the neck 20 of the metallic container, preventing the tamper indicator 82 from sliding back over the curl 28. As the rotational force continues to be applied to the threaded closure 44, the serrated band 86 interconnecting the tamper indicator 82 to the threaded closure 44 is severed and the tamper indicator 82 is retained on the neck 20 of the metallic container 4. The presence of the tamper indicator 82 on the neck of the metallic container provides a visual indication to a consumer that the closure 44 has been at least partially opened or unthreaded and the seal to the metallic container 4 compromised.

As illustrated in FIG. 5, in one embodiment of the present invention, a seal between the metallic container 4 and the threaded closure 44 is created by a geometry of at least one of the seals 68, 70, 72 formed on the threaded closure 44. The seals 68, 70, 72 of the threaded closure 44 are adapted to contact and apply a sealing pressure to at least one of the exterior surface 30, upper surface 32, and interior surface 34 of the curl 28 of the metallic container 4. The seal keeps the product in the metallic container 4 without leakage or infiltration of liquid or gas. Additionally, the seal prevents the contents of the metallic container 4 from going flat or oxidizing. Optionally, the seal between the metallic container 4 and the threaded closure 44 is not axisymmetric. In a non-axisymmetric seal, a predetermined portion of the seal can provide an initial and controlled venting of pressurized gas when the metallic container 4 is opened. This controlled venting may prevent foaming of the product. A non-axisymmetric seal may be formed between a metallic container 4 and a threaded closure 44 of all embodiments of the present invention. In one embodiment, the thread roller 90 or the pilfer roller 91 may contact and apply a force to one or more surfaces of the extension 66 to ensure contact between the seals 68, 70, 72 of the threaded closure 44 and the surfaces 30, 32, 34 of the metallic container 4 seals the metallic container 4.

In addition to providing a sealing surface, in one embodiment the exterior surface 30 of the curl 28 is used to align and provide concentricity of the threaded closure 44 and the metallic container 4. Thus, contact between the exterior surface 30 of the curl 28 and the outer seal 68 of the threaded closure 44 aligns the threaded closure 44 and the metallic container 4 to ensure a tight seal is achieved during sealing and thread forming by the apparatus 89. In one embodiment, the apparatus 89 optionally can form cuts or slots in the exterior surface 30 of a curl 28A-28D so that the exterior surface 30 is not continuous and is able to spring or flex for alignment with the threaded closure 44. Curls 28A-28D with a non-continuous exterior surface 30 are useful for aligning the threaded closure 44 and the metallic container 4 but do not provide a sealing surface for the threaded closure 44.

Optionally, a sealant may be applied to one or more of the metallic container 4 and the thread closure 44. The sealant may be used in addition to, or to replace, one or more of the seals 68, 70, 72 of the threaded closure 44K. The sealant may be applied to the threaded closure 44K before insertion of the threaded closure 44K into the bore 12 of the metallic container 4. Optionally, the sealant may be applied to the upper surface 32 of the curl 28. The sealant is formed by a material that is impervious to gases and liquids stored within the metallic container.

When the apparatus 89 inserts the threaded closure 44 into the bore 12, the pressure block 93 (illustrated in FIG. 5) can apply a top force to the threaded closure 44 to press the threaded closure 44 into the bore 12, compressing the sealant between the threaded closure 44 and the metallic bottle 4. In this manner, the sealant 78 can substantially fill the space between the threaded closure 44 and a portion of the metallic bottle, such as the curl 28, forming a seal between the metallic container 4 and the threaded closure 44.

The sealant may be similar to sealants used with crown closures and is well known to those of skill in the art. In one embodiment, the sealant is a liquid sealant that can at least partially flow between the metallic container 4 and the threaded closure 44 and harden to create a seal. In another embodiment, the sealant is a wad of a compressible material. In one embodiment, the sealant may allow a small amount of gas to slowly escape from or enter into the metallic container 4.

Additionally, or alternatively, liner may be interconnected to a lower surface of the extension 66 of the closure 44. When the threaded closure 44 is inserted into the bore 12 of a metallic container 4 before threads are formed on the metallic container, the liner is compressed between a lower surface of the extension 66 and an upper surface 32 of a curl 28 of the metallic container 4. The compression of the liner forms a seal to prevent venting of the contents of the metallic container 4 and/or transmission of $CO_2$ or $O_2$ into, or out of, the interior of the metallic container 4. The liner may be formed of a flexible material that is substantially impervious to liquids and/or gases. In one embodiment, the liner is formed of a material that absorbs $CO_2$ and/or $O_2$.

Figure 6B:
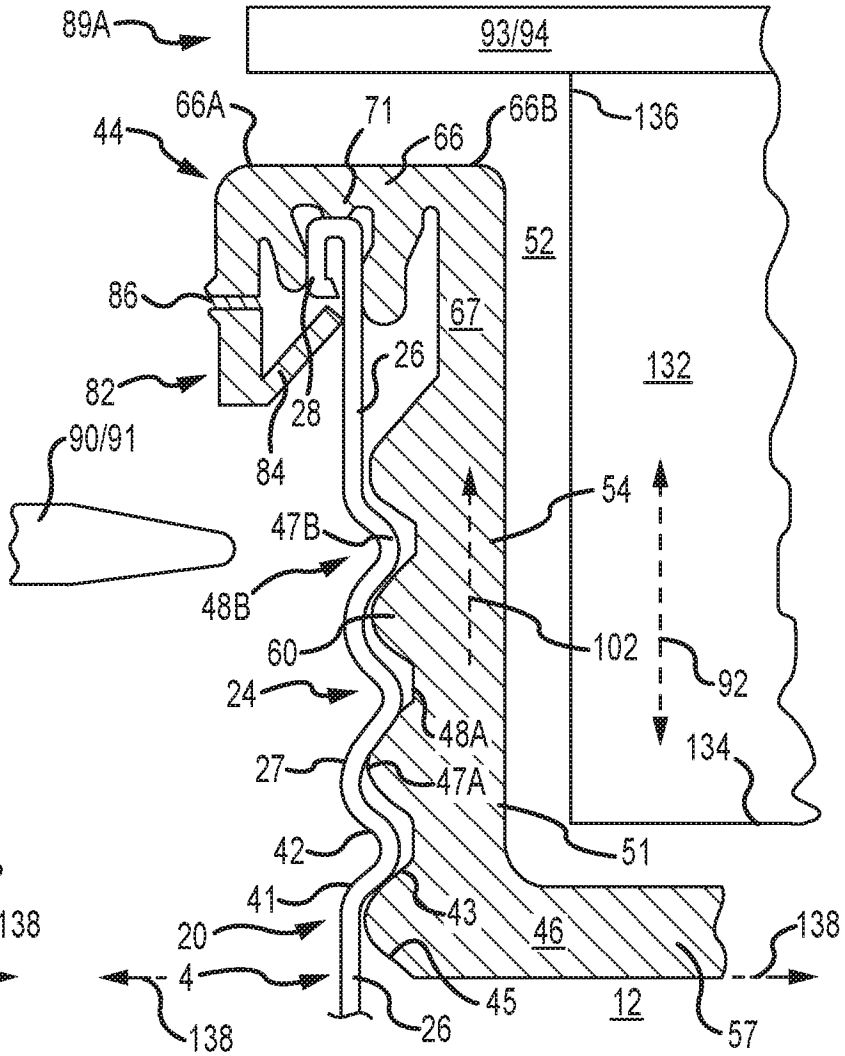
FIG. 6B generally illustrates a partial front elevation cross-sectional view of the metallic container sealed by the apparatus of FIG. 6A.
Figure 6A:
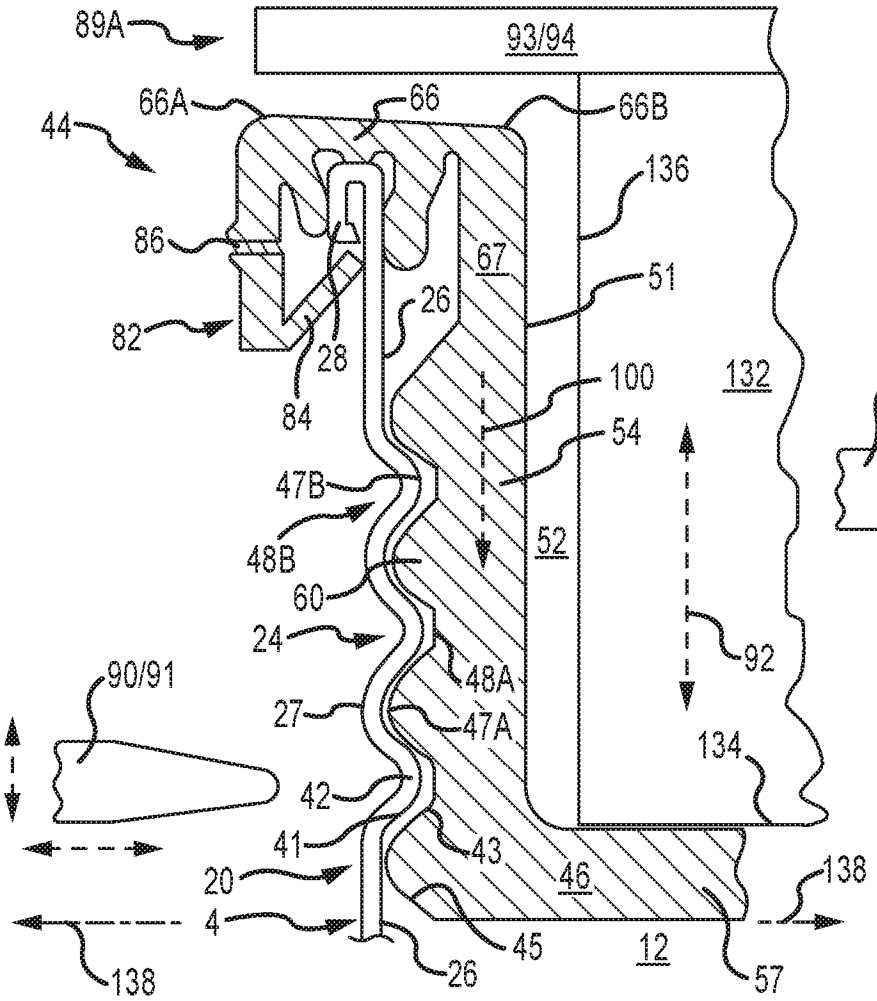
FIG. 6A illustrates a partial front elevation cross-sectional view of an apparatus configured to seal a metallic container with a threaded closure according to one embodiment of the present invention.

Referring now to FIG. 6A, an apparatus 89A of another embodiment of the present invention is generally illustrated. Apparatus 89A is similar to the apparatus 89 described in conjunction with FIG. 5 and can include many of the same, or similar, features. For example, apparatus 89 can include one or more of a thread roller 90 and optionally a pilfer roller 91. Similar to other embodiments of the apparatus 89 described herein, apparatus 89A can form container threads 42 on a metallic container 4 after a threaded closure 44 is positioned within an opening 12 of the metallic container.

Notably, apparatus 89A utilizes an interior tool 132 of one embodiment of the present invention. The interior tool may be interconnected to the pressure block 93 and/or the chuck 94. In this manner, the interior tool may move vertically relative to vertical axis 92. The interior tool 132 is adapted to be positioned within an interior of a chamber 52 of a threaded closure 44.

The interior tool 132 is configured to apply a force to the threaded closure 44 to push the threaded closure deeper into the container bore or opening 12 before threads are formed on the metallic container. In one embodiment, the interior tool 132 applies the force to a portion of the threaded closure positioned inward of container curl 28. In this manner, the container curl 28 may define a pivot point which allows an outer portion 66A of the closure extension 66 to pivot upwardly from a reference plane 138 defined by a bottom portion 57 of the threaded closure. In one embodiment, the closure extension 66 may move into a concave orientation when the interior tool 132 applies the force to the threaded closure as generally illustrated in FIG. 6A.

The interior tool 132 generally includes an endwall 134 and a sidewall 136. The endwall 134 is configured to contact and apply a force to a bottom portion 57 of the closure chamber 52. In one embodiment, the endwall 134 is generally planar. Other shapes are contemplated for the endwall 134. For example, the endwall 134 can have a shape that substantially corresponds to the shape of the closure bottom portion 57.

The sidewall 136 of the interior tool can have a shape that is generally cylindrical. However, the interior tool 132 may have any shape that generally corresponds to the shape of the chamber 52. In one embodiment, the sidewall 136 can be configured to contact an interior surface 51 of a sidewall 67 defining the chamber 52. Optionally, the interior tool 132 can be adapted to contact and provide support to the interior surface 51 of the closure sidewall 67 as a tool, such as a thread roller 90, applies a force to the container neck 20 to form container threads 42 on the metallic container 4. In one embodiment, the sidewall 136 has an exterior diameter that is less than an interior diameter of the closure chamber 52.

The apparatus 89A can be configured to position the interior tool 132 in a predetermined alignment with respect to the chamber 52 of the threaded closure 44. In one embodiment, the apparatus 89A can move the interior tool 132 generally parallel to a longitudinal axis 92 of the metallic container 4. In this manner, the apparatus 89A can move the interior tool 132 into and out of the chamber 52. Additionally, or alternatively, the apparatus 89A can optionally move the metallic container 4 and the threaded closure 44 along the longitudinal axis 92. Accordingly, in one embodiment, the apparatus can move the metallic container 4 and the threaded closure 44 such that the closure chamber 52 moves relative to the interior tool 132 until the interior tool 132 is within the chamber.

The interior tool 132 is configured to apply a downward force or a vertical load to the bottom portion 57 of the threaded closure 44. In one embodiment, the interior tool 132 is configured to apply not more than approximately 300 pounds, or less than approximately 200 pounds, of downward force to the closure bottom portion 57. In another embodiment, the downward force that can be applied by the interior tool is less than approximately 125 pounds. Optionally, the interior tool can apply at least approximately 10 pounds of downward force to the closure bottom portion. In still another embodiment, the interior tool 132 can optionally apply between approximately 10 pounds and approximately 100 pounds of downward force to the closure bottom portion 57.

As the interior tool 132 applies the downward force to the closure bottom portion 57, the closure bottom portion is pressed further into a bore 12 of the metallic container 4 as generally indicated by arrow 100. More specifically, the closure bottom portion 57 is pressed closer to the bottom 6 (illustrated in FIGS. 1 and 10) of the metallic container 4 by the force from the interior tool 132. However, the threaded closure 44 includes an extension 66 extending outwardly from the closure body 46. The extension 66 contacts an upper surface or curl 28 of the metallic container 4 as the threaded closure is pressed into the bottle bore 12. Contact between the extension 66 and the curl 28 prevents an upper portion of the threaded closure from moving into the bottle bore 12. In this manner, the interior tool 132 elastically deforms, or creates tension, in the threaded closure 44.

In one embodiment, at least a sidewall 67 of the threaded closure can be elastically deformed or placed in tension when the interior tool 132 applies the force to the closure bottom portion 57. Additionally, the downward force from the interior tool 132 may increase the pitch of closure threads 60. More specifically, the distance between adjacent peaks 47A of the closure threads may increase by between approximately 0.003 inches and approximately 0.015 inches.

In one embodiment, as the interior tool 132 applies the downward force to the closure bottom portion 57, the extension 66 can be elastically flexed. Specifically, the extension 66 can flex or bend such that an outer portion 66A of the extension 66 can remain approximately stationary. In contrast, an inner portion 66B of the extension can move at least partially toward the container bottom 6. In this manner, the extension 66 can be elastically flexed into a concave shape.

In one embodiment, when the interior tool 132 applies the downward force, the outer portion 66A of the extension is higher than the inner portion 66B as generally illustrated in FIG. 6A. For example, the outer portion 66A of the extension can be further than the extension inner portion 66B from a plane 138 defined by the closure bottom portion 57, the plane 138 being substantially perpendicular to the longitudinal axis 92. In another embodiment, the downward force from the interior tool 132 can alter an angle at which the extension 66 projects from the closure body 46. In one embodiment, the force from the interior tool 132 alters the angle of the extension 66 by between approximately 0.5° and approximately 10°, or between approximately 3° and approximately 6°.

In one embodiment, the interior tool 132 is configured to push the closure bottom portion 57 not more than approximately 0.050 inches into the bottle bore 12 toward the container bottom 6. Optionally, in another embodiment, the closure bottom portion 57 can move between approximately 0.005 inches and approximately 0.10 inches, or approximately 0.020 inches further into the bore 12 in response to the downward force from the interior tool 132. In one embodiment, the first force from the interior tool 132 presses the closure bottom between approximately 0.005 inches and approximately 0.015 inches closed to the bottom of the metallic container.

Additionally, or alternatively, in one embodiment the interior tool is operable to push the closure bottom portion 57 approximately one-half of the pitch of the closure threads 60, or one-half of the distance between adjacent peaks 47A of the closure threads 60, further into the metallic container 4. The closure threads 60 can have a pitch of less than approximately 0.16 inches. Optionally, the peaks 47A of the closure threads have a shape that is rounded. Alternatively, the peaks 47A may have a shape that is generally planar, such as illustrated in FIG. 9.

The apparatus 89A can form threads 42 on a neck 20 of the metallic container 4 while the interior tool 132 applies the downward force to the closure bottom portion 57. In this manner, the container threads 42 can be formed while the threaded closure 44 is elastically deformed or in tension.

In one embodiment, the container threads 42 can be formed by a thread roller 90 in a manner that is the same as, or similar to, the operation of the thread roller 90 described in conjunction with FIG. 5. More specifically, a tool 90, such as a thread roller 90 is configured to press against an exterior surface 27 of the neck to apply a sideload to the neck. In this manner, a thread region 24 of the neck 20 can be compressed between the thread roller 90 and the closure threads 60. As the container threads 42 are formed, the sideload applied by the thread roller 90 presses an interior surface 26 of the neck against the closure threads 60. The thread roller 90 generally winds around the neck following a closure thread 60 of the threaded closure when forming the container threads 42.

One benefit of forming the container threads 42 while the interior tool 132 applies the downward force is that a lower surface of the closure extension 66 can be pressed against an upper surface of the metallic container 4, such as the curl 28. The interior tool 132 can also maintain a predetermined radial or axial alignment between the threaded closure 44 and the metallic container 4 during formation of the container threads 42. In this manner, the interior tool 132 can beneficially maintain a predetermined fit between the closure threads 60 and the interior surface 26 of the container neck. For example, the interior tool 132 can maintain the threaded closure 44 and the metallic container 4 in a substantially coaxial alignment. More specifically, the downward force applied by the interior tool 132 can prevent unintended or inadvertent movement of the threaded closure 44 with respect to the metallic container 4, such as tipping or lateral movement of the threaded closure 44. Such tipping or lateral movement of the threaded closure can decrease the effectiveness of the seal between the threaded closure 44 and the metallic container 4 and result in accidental opening or venting of the metallic container. As will be appreciated by one of skill in the art, if the threaded closure 44 tips relative to the metallic container during sealing, a longitudinal axis of the threaded closure will not be parallel to the longitudinal axis 92 of the metallic container.

Referring now to FIG. 6B, after the container threads 42 have been formed the apparatus 89A can separate the interior tool 132 from the threaded closure 44 to remove (or release) the downward force from the closure bottom 57. In one embodiment, the apparatus 89A can move the interior tool 132 along the axis 92 while the threaded closure 44 remains generally stationary. Additionally, or alternatively, the apparatus 89A can move the threaded closure 44 and the metallic container 4 away from the interior tool 132 while the interior tool 132 remains generally stationary.

In one embodiment, the apparatus 89A can form the container threads 42 when the metallic container 4 is filled with a product, such as a beverage. After the container threads 42 have been formed, the product is sealed within the metallic container. The apparatus 89A can subsequently release or eject the sealed metallic container 4.

When the downward force applied by the interior tool 132 to the closure bottom 57 is released, the closure body 46 can at least partially spring back. In one embodiment, the extension 66 can act as a biasing mechanism to move the closure threads 60 away from the container bottom 6 as generally indicated by arrow 102. Specifically, the closure threads 60 can move a distance away from the container bottom 6 such that upper surfaces 43 of the closure threads 60 press against lower surfaces 41 of the container threads 42. For example, as generally illustrated in FIG. 6A, while the interior tool 132 applies the downward force, the lower surfaces 41 of the container threads 42 are spaced from the upper surfaces 43 of the closure threads 60. In contrast, in FIG. 6B, the upper surfaces 43 of the closure threads contact, and can apply a force to, the lower surfaces 41 of the container threads.

In one embodiment, the closure threads 60 can apply up to approximately 45 pounds, or approximately 25 pounds of force to the container threads 42. Specifically, in one embodiment, an upper surface 43 of the closure threads 60 can apply between approximately 1 pound and approximately 45 pounds of force to a lower surface 41 of the container threads 42 after the interior tool 132 is withdrawn from contact with the container bottom 57. In another embodiment, the closure threads apply between approximately 2 pounds and approximately 20 pounds of force to the container threads.

Contact between the lower surfaces 41 of the container threads and the upper surfaces 43 of the closure threads creates tension in the threaded closure 44 improving the seal between the threaded closure and the metallic container. More specifically, in one embodiment, the container threads 42 prevent or stop the upward movement of the closure threads 60 away from the container bottom such that at least an upper portion 54 of the closure body 46 between the closure threads 60 and the extension 66 is in tension. In one embodiment, after the metallic container 4 has been sealed with the threaded closure 44, the threaded closure can be removed from the metallic container by applying between approximately 5 in-lbs and approximately 20 in-lbs, or approximately 15 in-lbs of torque to the threaded closure in an opening direction.

In one embodiment, the extension 66 generally returns at least partially to an initial position when the downward force applied by the interior tool 132 is removed. However, in one embodiment, the container curl 28 will remain in contact with a portion of the extension 66 after the downward force from the interior tool 132 is removed. For example, as generally illustrated in FIG. 6B, the container curl 28 may contact one or more portions 71 of the closure extension 66.

In one embodiment, in the initial position the extension 66 projects generally radially away from the closure body 46. More specifically, in one embodiment, the outer and inner portions 66A, 66B of the extension are spaced substantially equal distances from the plane 138 defined by the closure bottom 57. In another embodiment, the extension 66 bends back at least partially toward the initial angle at which the extension 66 projected from the closure body 46 before the interior tool 132 applies the downward force. Other shapes and orientations of the extension 66 are contemplated, such as generally illustrated in FIGS. 7-8.

Additionally, after the container threads have been formed and the downward force from the interior tool 132 is released, the closure threads 60 may return at least partially to their original pitch. More specifically, the distance between adjacent peaks 47A of the closure threads may decrease when the downward force is released. In one embodiment, the distance between adjacent peaks 47A of the closure threads 60 may decrease by between approximately 0.001 inch and approximately 0.01 inches.

In one embodiment, the movement and operation of the interior tool 132, the thread roller 90, and the optional pilfer roller 91 are controlled by mechanical linkages which are not shown for clarity. For example, in one embodiment, the movement of the interior tool 132 and the thread roller 90 are controlled by the interaction of a cam with a cam follower. In one embodiment, a machine cam drives a capping head and/or the pressure block 93 downward onto the metallic container. The thread roller 90 and the interior tool 132 may be interconnected to the capping head. As the capping head drives the interior tool 132 to apply a downward load or a first force to the threaded closure, an internal spring loaded mechanism of the capping head will compress. As the internal mechanism of the capping head compresses, a cam internal to the capping head (an internal cam) forces the thread roller 90 into operation to form the container threads 42.

In one embodiment, the capping apparatus 89 includes only one machine cam and only one internal cam. Alternatively, in another embodiment, the capping apparatus 89 includes two or more machine cams. Each load or force applied by the capping apparatus can be actuated by its own machine cam. In this embodiment, the machine cam does not include an internal cam.

Referring now to FIG. 7, an apparatus 89B of another embodiment of the present invention is generally illustrated. The apparatus 89B is operable to seal a product within a metallic container 4 with a threaded closure 44Y of still another embodiment of the present invention. The apparatus 89B is similar to other apparatus 89 of the present invention and can include the same or similar tools 90, 91. Accordingly, the apparatus 89B can form container threads 42 on the metallic container after the threaded closure 44Y is positioned within the open end of the metallic container.

Notably, the apparatus 89B includes a capping tool 152A. In one embodiment, a lower surface of the capping tool 152A that is adjacent to the threaded closure 44 is generally planar. The capping tool 152A can be interconnected to a pressure block 93 of the apparatus, such as generally illustrated in FIG. 5. In one embodiment, the apparatus 89B can move the capping tool 152A vertically relative to a longitudinal axis 92 of the metallic container 4.

In one embodiment, the movement and operation of the thread roller 90, the optional pilfer roller 91, and capping tool 152A may be controlled by mechanical linkages which are not shown for clarity. For example, in one embodiment, the movement of one or more of the thread roller 90, the pilfer roller 91, and the interior tool 132 is controlled by the interaction of a cam with a cam follower, such as in response to engagement of the cam with the cam follower. Optionally, the movement of the capping tool 152A and the thread roller 90 are controlled by the interaction of a cam with a cam follower as described in conjunction with the capping apparatus 89A generally illustrated in FIG. 6. More specifically, the capping apparatus 89B may include a machine cam which drives a capping head downward onto the metallic container. The thread roller 90 and the capping tool 152A may be interconnected to the capping head. As the capping head drives the capping tool 152A to apply a top load or a first force to the threaded closure, an internal spring loaded mechanism of the capping head will compress. As the internal mechanism of the capping head compresses, a cam internal to the capping head (an internal cam) forces the thread roller 90 into operation to form the container threads 42 on the metallic container 4.

The threaded closure 44Y is similar to other threaded closures 44 of the present invention. More specifically, the threaded closure generally includes a closure body 46 with a chamber 52 defined by a bottom portion 57 and a sidewall 67. Closure threads 60 are formed on an exterior surface of the closure body.

An extension 66 can project outwardly from the closure body 46 at a predetermined angle relative to the closure sidewall 67. More specifically, and referring now to FIG. 7A, an outer portion 66A of the extension can be angled toward a plane 138A defined by the bottom portion 57 of the threaded closure. Accordingly, the outer portion 66A can be spaced from a second plane 138B defined by a surface of the capping tool 152A of the apparatus 89B. In one embodiment, the outer portion 66A is spaced a predetermined distance 142 from the second plane 138B when the capping tool 152A contacts an inner portion 66B of the extension. Accordingly, the extension 66 is not flat.

In one embodiment, the extension outer portion 66A is spaced a distance 142, or Δy, further from the second plane 138B than the extension inner portion 66B. As one of skill in the art will appreciate, the distance Δy may vary based on the diameter of the extension 66 and the angle of the extension relative to the closure sidewall 67. In one embodiment, the distance Δy is not more than approximately 0.050 inches. Optionally, in another embodiment the distance Δy is between approximately 0.010 inches and approximately 0.10 inches, or about 0.020 inches. Additionally, or alternatively, in one embodiment the distance Δy can be no more than approximately one-half of the pitch of the threads, or one-half of the distance between adjacent peaks 47A of the closure threads 60. The closure threads 60 can have a pitch of less than approximately 0.16 inches. In one embodiment, the thread peaks 47A can be generally planar. Alternatively, in another embodiment, the thread peaks 47A may have a shape that is rounded or arcuate, such as generally illustrated in FIG. 6.

The downward orientation of the extension 66 is beneficial during sealing of a metallic container 4. More specifically, the downward orientation of the extension provides pre-tensioning of the threaded closure 44Y when a downward force is applied to the threaded closure by the capping apparatus 89B.

Figures 7A, 7B, 7C:
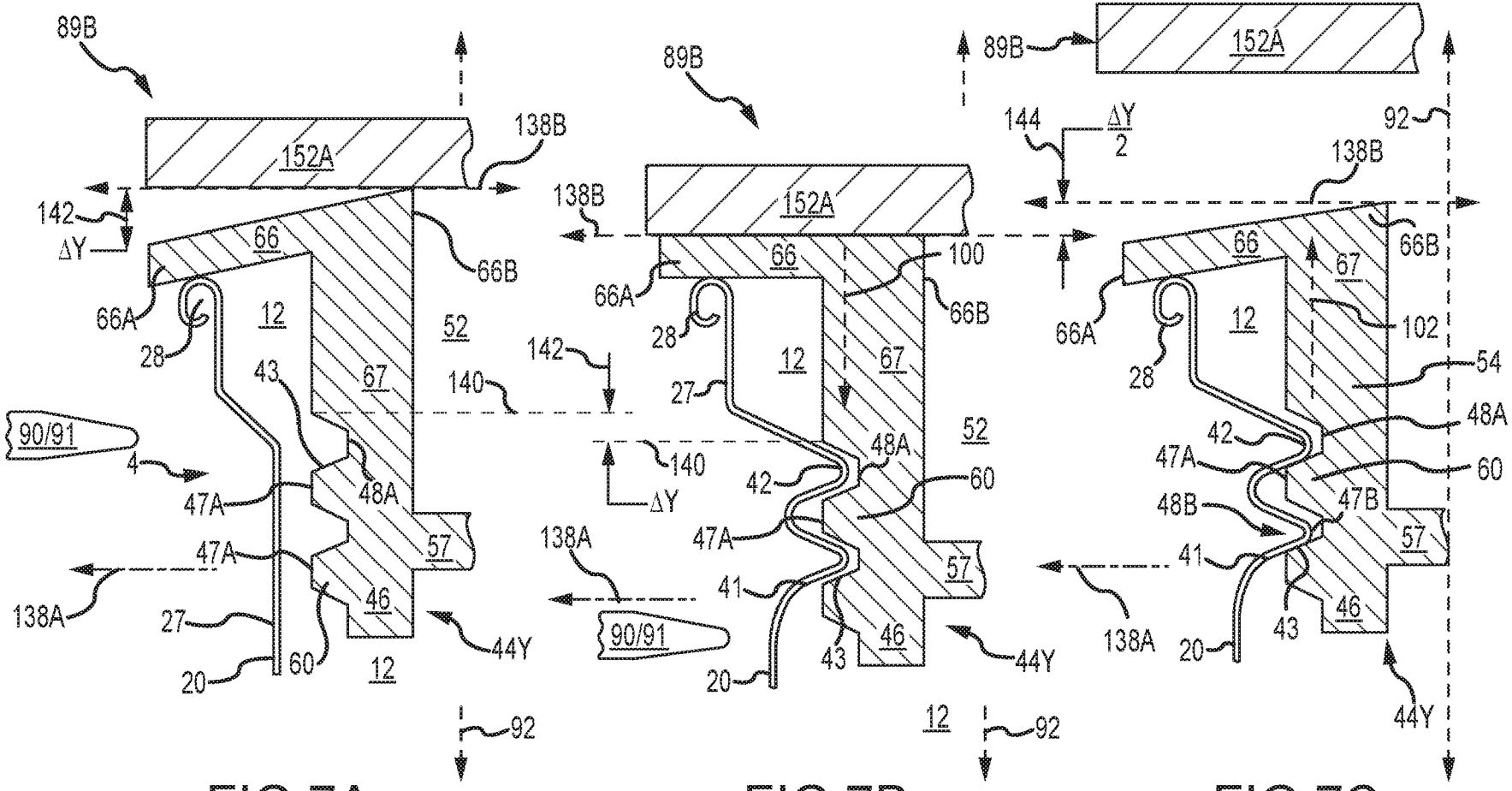
FIGS. 7A-7C are partial front elevation cross-sectional views of another apparatus of the present invention sealing a metallic container with a threaded closure.
Figure 8:
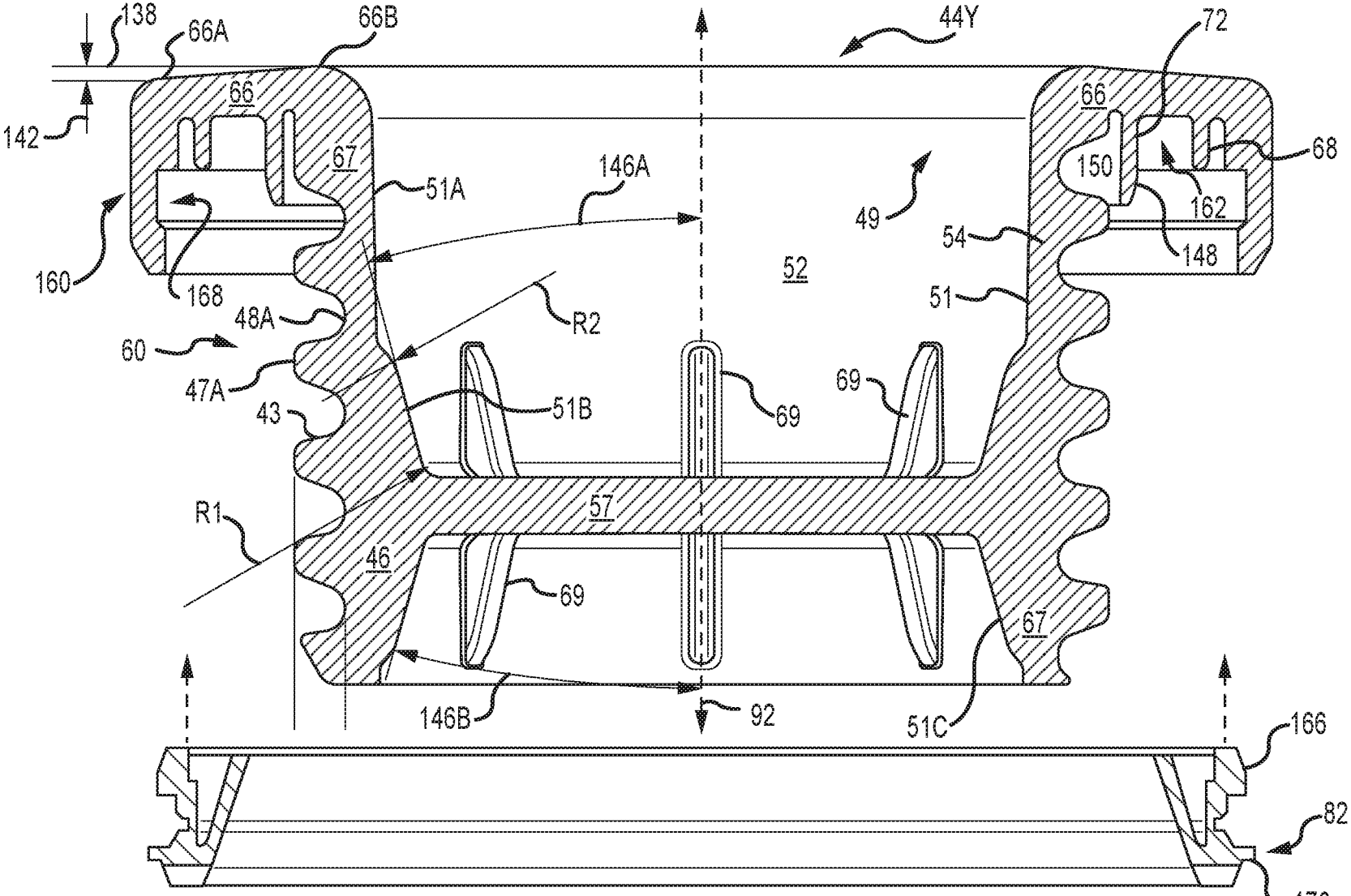
FIG. 8 is a cross-sectional front elevation view of a threaded closure of one embodiment of the present invention.

Referring now to FIG. 7B, after the threaded closure 44Y is positioned within an opening or a bore 12 of the metallic container, the capping tool 152A of the apparatus 89B can apply a downward force to the extension 66. The downward force from the capping tool 152A can be directed toward a bottom 6 of the metallic container 4. The container bottom 6 is not illustrated in FIG. 7 for clarity but can be the same as, or similar to, the container bottom 6 illustrated in FIG. 1 or FIG. 10. In one embodiment, the apparatus 89B is operable to move the metallic container 4 and threaded closure 44Y such that the extension 66 contacts the capping tool 152A. Additionally, or alternatively, the apparatus 89B can move the capping tool 152A into contact with the extension 66.

The capping tool 152A is configured to apply the downward force to a portion of the threaded closure 44Y positioned inward of the container curl 28. In this manner, the container curl 28 can act as a pivot point as the downward force drives the bottom portion 57 of the threaded closure further into the bore 12 of the metallic container 4.

In one embodiment, the downward force is less than approximately 300 pounds. In another embodiment, the force is less than approximately 200 pounds. Optionally, the downward force can be greater than approximately 10 pounds and less than 110 lbs. In one embodiment, the downward force applied to the extension 66 by the capping tool 152A can be between approximately 10 pounds and approximately 300 pounds. Optionally, the downward force applied by the capping tool 152A is approximately 100 pounds.

The downward force applied to the extension 66 can press the closure body 46 and the closure threads 60 further into the bore 12 toward the bottom 6 of the metallic container 4. In one embodiment, the closure threads 60 move approximately the distance 142, or Δy, further into the bore 12. The movement of the closure threads 60 into the bore is generally illustrated by different positions of a reference plane 140 shown in FIGS. 7A and 7B. The reference plane 140 intersects an upper portion of the closure threads 60 and is generally perpendicular to a longitudinal axis 92 of the metallic container 4. In one embodiment, the downward force from the capping tool 152A presses the threaded closure between approximately 0.005 inches and approximately 0.1 inches, or between approximately 0.005 inches and approximately 0.015 inches, toward the bottom portion of the metallic container.

As the downward force moves the closure threads further into the container bore 12, the extension contacts a portion of the metallic container 4, such as the curl 28, preventing at least the outer portion 66A of the extension from moving toward the container bottom 6. In this manner, the downward force from the capping tool 152A one or more of elastically deforms the threaded closure and places the threaded closure 44Y in tension.

In one embodiment, the downward force applied to the extension 66 also elastically flexes the extension 66. In one embodiment, the extension 66 is flattened such that the inner and outer extension portions 66A, 66B are substantially equally spaced from the plane 138A. More specifically, in one embodiment, the downward force from the capping tool 152A alters the angle of the extension 66 relative to the closure body 46. In one embodiment, the downward force alters the angle at which the extension 66 projects from the closure body 46 by between approximately 0.5° and approximately 10°. Optionally, the downward force alters the angle by between approximately 3° and approximately 6°.

Additionally, the downward force from the capping tool 152A can beneficially keep the threaded closure and metallic container in a predetermined alignment. More specifically, the capping tool 152A can press the extension 66 against the container curl 28 such that unintended or inadvertent movement of the threaded closure relative to the metallic container, such as tipping, is prevented. Further, the downward force from the capping tool can maintain the threaded closure 44 and the metallic container 4 in a substantially coaxial alignment. In this manner, the seal between the threaded closure and the metallic container is more efficient.

The apparatus 89B can form threads 42 on the metallic container 4 while the downward force is applied to the extension as generally illustrated in FIG. 7B. In one embodiment, the apparatus 89B can form the container threads 42 in a manner similar to other apparatus 89, 89A of the present invention. More specifically, in one embodiment, a tool 90, such as a thread roller 90 can apply a force to an exterior surface 27 of the container neck 20. In this manner, the container neck 20 can be compressed between the thread roller 90 and the closure threads 60 to form the container threads 42 while the threaded closure is in tension or elastically deformed. Optionally, the apparatus 89B may form the container threads 42 using any other tool and method described herein. After the container threads 42 have been formed, the product is sealed within the metallic container 4. The apparatus 89B may subsequently release or eject the sealed metallic container 4.

Referring now to FIG. 7C, after forming the container threads 42, the apparatus 89B removes the downward force from the extension 66. This may be accomplished by moving the metallic container 4 and threaded closure 44Y away from the capping tool 152A. Additionally, or alternatively, the capping tool 152A can be moved away from the extension 66.

After the downward force has been removed from the closure extension 66, the extension can return at least partially to its original shape. In one embodiment, the container curl 28 will remain in contact with a portion of the extension 66 after the downward force from the capping tool 152A is removed. For example, as generally illustrated in FIG. 7C, the container curl 28 may contact a lower surface of the closure extension 66 after the downward force from the capping tool is removed.

In one embodiment, the extension 66 may act as a biasing mechanism to move the closure threads 60 away from the container bottom 6. More specifically, the inner portion 66B of the extension can move at least partially away from the bottom 6 of the metallic container 4 as generally indicated by arrow 102. However, upper surfaces 43 of the closure threads contact lower surfaces 41 of the container threads. The contact between surfaces 41, 43 restricts (or limits) the movement of the extension inner portion 66B and the closure threads 60 relative to the container bore 12. In one embodiment, the inner portion 66B of the extension can move up to a distance 144 away from the container bottom 6. In one embodiment, the distance 144 is approximately $\Delta y/2$. In another embodiment, the distance 144 is not greater than approximately ¼ of the pitch of the closure threads 60. As will be appreciated by one of skill in the art, the thread pitch is the distance between adjacent peaks 47A of the closure threads. In another embodiment, the distance 144 is less than or equal to approximately 0.025 inches. In still another embodiment, the distance 144 is between approximately 0.0050 inches and approximately 0.050 inches. Optionally, the pitch of the closure threads 60 is not greater than approximately 0.1 inches. In another embodiment, the thread pitch is less than approximately 0.16 inches.

In one embodiment, the contact between the lower surface 41 of the container threads and the upper surface 43 of the closure threads applies a force to the container threads 42. More specifically, in one embodiment, the upper surfaces 43 of the closure threads 60 apply a force to the container threads 42 and place the threaded closure 44Y in tension. In one embodiment, at least an upper portion 54 of the threaded closure above the closure threads 60 is in tension due to the upward movement of the threaded closure being restricted by the container threads. In another embodiment, at least the upper portion 54 above the uppermost container thread peak 47B and the extension 66 is in tension.

In one embodiment, the closure threads 60 can apply up to approximately 45 pounds, or approximately 25 pounds of force to the container threads 42. Specifically, in one embodiment, an upper surface 43 of the closure threads 60 can apply between approximately 2 pounds and approximately 45 pounds of force to a lower surface 41 of the container threads 42 after the capping tool 152A is separated from contact with the metallic container 4. The tension in the threaded closure 44Y can improve the seal between the threaded closure 44 and the metallic container 4.

Referring now to FIG. 8, a threaded closure 44Y of one embodiment of the present invention is generally illustrated. The threaded closure can include many of the same features as other closures 44 described herein. In one embodiment, the threaded closure 44Y generally includes one or more of a body 46 and threads 60 formed on an exterior surface of a sidewall 67. The threaded closure 44Y can be formed of a plastic or a metal. In one embodiment, the threaded closure 44Y is formed of injection molded plastic.

Optionally, a chamber 52 can be formed in the body 46. The chamber 52 is generally defined by a bottom portion 57, an interior surface 51 of the sidewall 67, and an opening 49. One or more buttresses 69 can optionally project into the chamber 52 between the bottom portion 57 and the sidewall 67. In one embodiment, at least a portion 51A of the sidewall interior surface 51 is generally parallel to a longitudinal axis 92 of the threaded closure 44Y. Another portion 51B of the interior surface 51 may optionally be angled relative to the longitudinal axis 92. More specifically, in one embodiment, the interior surface portion 51B can be oriented at an angle 146A of between approximately 10° and 25° relative to the longitudinal axis 92.

In one embodiment the sidewall interior surface 51 has a first radius of curvature R1 between the bottom portion 57 and the interior surface portion 51B. In one embodiment, the first radius of curvature R1 is between approximately 0.01 inches and approximately 0.04 inches. The sidewall 51 can also include a second radius of curvature R2 between interior surface portion 51B and portion 51A. In one embodiment, the second radius of curvature R2 is between approximately 0.110 inches and approximately 0.300 inches, or approximately 0.20 inches.

In one embodiment, the sidewall 67 extends below the bottom portion 57. An interior surface 51C of the sidewall can be angled outwardly away from bottom portion. Optionally an angle 146B between the interior surface 51C and the longitudinal axis 92 is between approximately 10° and 25°.

In one embodiment, a buttress 69 can optionally be formed between the bottom portion 57 and the interior surface 51C.

The threaded closure 44Y can include an extension 66 that projects outwardly from the sidewall 67. Notably, an upper surface of the extension is angled relative to the longitudinal axis 92. Accordingly, an outer portion 66A of the extension is spaced from a plane 138 that intersects an inner portion 66B of the extension. The plane 138 is generally perpendicular to longitudinal axis 92. More specifically, in one embodiment, the outer portion 66A of the extension is angled downwardly away from a horizontal plane 138 that contacts an inner portion 66B of the extension.

During sealing of a metallic container 4 with the threaded closure 44Y by a capping apparatus 89 of the present invention, the downward orientation of the extension 66 beneficially promotes pre-tensioning of the threaded closure when a downward force is applied to the threaded closure by the capping apparatus. Moreover, when the downward force from the capping apparatus is removed, the extension 66 can serve as a biasing element to pull a bottom portion 57 of the threated closure upwardly away from the bottom 6 of the metallic container. In this manner, upper surfaces 43 of the closure threads 60 can apply a force against lower surfaces of the container threads to improve the seal between the threaded closure and the metallic container. The force from the closure threads places the threaded closure 44Y in tension. More specifically, in one embodiment, after a metallic container is sealed with the threaded closure 44Y, at least an upper portion 54 of the threaded closure will be in tension. In one embodiment, the upper portion 54 of the threaded closure which will be in tension is above an uppermost thread of the metallic container.

In one embodiment, the outer portion 66A is separated from the plane 138 by a distance 142 of not more than approximately 0.050 inches. Optionally, in another embodiment, the distance 142 is between approximately 0.010 inches and approximately 0.10 inches, or approximately 0.020 inches. In another embodiment, the distance 142 is a predetermined fraction of the distance between adjacent peaks 47A of the closure threads 60. In one embodiment, adjacent peaks 47A of the threads are separated by up to approximately 0.1 inches. The distance between the adjacent peaks 47A defines a pitch of the threads 60. Alternatively, the thread pitch can be up to approximately 0.140 inches, or up to approximately 0.16 inches. In one embodiment, the thread peaks 47A are generally planar. Alternatively, in another embodiment, the thread peaks 47A can have a shape that is rounded or arcuate, such as generally illustrated in FIG. 6.

Optionally, a plug seal 72 can extend downwardly from the extension 66. In one embodiment, the plug seal 72 includes an exterior surface 148 that is configured to contact an interior surface 26 of a metallic container 4 of the present invention. The exterior surface 148 can have an arcuate shape that substantially conforms to the container interior surface 26. In one embodiment, the plug exterior surface 148 can have a maximum outer diameter of between approximately 1.1 inches and approximately 1.3 inches.

As one of skill in the art will appreciate, it is sometimes difficult to remove items with negative draft angles from an injection mold. Accordingly, in one embodiment of the present invention, the exterior surface 148 of the plug seal 72 is not angled away from the longitudinal axis 92 of the threaded closure. In another embodiment, at least a portion of the exterior surface is generally parallel to the longitudinal axis 92. Optionally, the exterior surface 148 tapers toward the longitudinal axis 92 proximate to a free end of the plug seal 72. In one embodiment, in a longitudinal cross-section of the threaded closure as generally illustrated in FIG. 8, an interior surface 150 of the plug seal 72 is generally linear. The interior surface 150 may optionally be substantially parallel to the longitudinal axis 92.

The threaded closure 44Y can also include an alignment element 68 that extends downwardly from the extension 66. The alignment element 68 is spaced from the plug seal 72 by a distance sufficient to receive a curl of a metallic container 4 of the present invention. The alignment element 68 can be configured to guide the curl 28 between the alignment element and the plug seal 72. In one embodiment, the alignment element 68 is adapted to bias the container curl 28 inwardly such that the plug seal can contact an interior surface 26 of the container neck.

The plug seal 72 may define an inner portion of a recess 162 formed in the extension. An outer portion of the recess may be defined by the optional outer seal or alignment element 68. The recess 162 may have a geometry to receive an uppermost portion of a metallic container, such as the curl 28.

Optionally, the threaded closure 44Y can be configured to retain a tamper indicator 82. More specifically, the threaded closure 44Y may optionally include a skirt 160 that extends downwardly from the extension 66. In one embodiment, a lowermost portion of the skirt 160 does not extend below an uppermost portion of the closure threads 60. Accordingly, when the threaded closure 44Y is positioned within a bore of a metallic container 4 of the present invention, threads can be formed on a neck 20 of the metallic container 4 by applying a force to the neck to press the metallic container against the closure threads 60 without interference from the skirt 160.

In one embodiment, a groove 168 is formed in the skirt 160. The groove 168 has a geometry configured to be engaged by the tamper indicator 82. In one embodiment, the tamper indicator 82 includes a catch 166 to mechanically engage the groove 168. The tamper indicator 82 can also include a flange 170 configured to engage a lowermost portion of the skirt 160. The tamper indicator 82 is described in more detail in conjunction with FIG. 10C.

Referring now to FIG. 9, still another apparatus 89C of the present invention is generally illustrated. The apparatus 89C is configured to seal a product within a metallic container 4 with a threaded closure 44 of one embodiment of the present invention. The apparatus 89C generally includes a tool 90, such as a thread roller 90 and, optionally a pilfer roller that can be the same as or similar to similar tools of other embodiments of apparatus 89 described herein. In addition, the apparatus includes a capping tool 152B adapted to press the threaded closure 44 into the bore 12 of the metallic container 4 to elastically deform the threaded closure or create tension in threads 60 of the threaded closure 44. The capping tool 152B may be controlled by the interaction of a cam with a cam follower as generally described in conjunction with the capping apparatus 89A, 89B.

The capping tool 152B generally includes a body 154 and a flange 156. In one embodiment, the body 154 is adapted to fit at least partially within a chamber 52 of the threaded closure 44. In one embodiment, the body 154 can have a shape that is generally cylindrical. Other shapes for the body are contemplated. For example, the body 154 may optionally have a conical shape with a sidewall that is oriented inwardly toward the longitudinal axis 92. In one embodiment, the body 154 has a generally frustoconical shape with a sidewall that is not parallel to the longitudinal axis. The body 154 generally has an exterior diameter that is less than an interior diameter of the chamber 52 of the threaded closure 44.

Figure 9B:
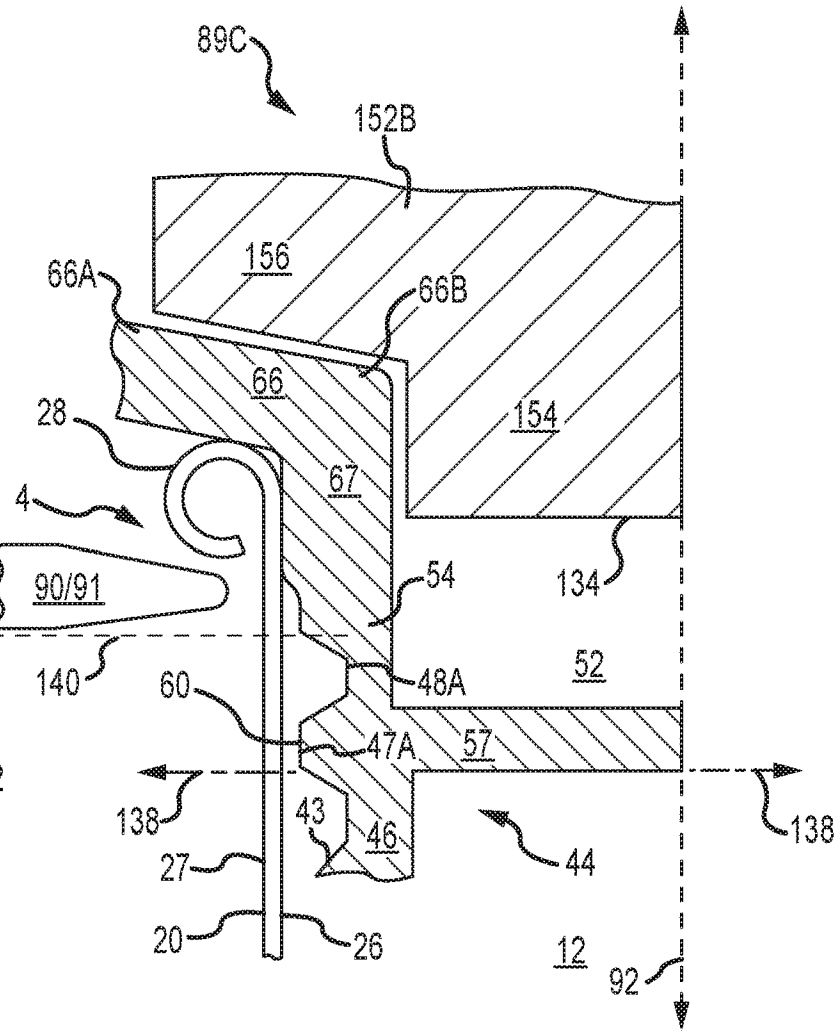
FIGS. 9A and 9B are partial cross-sectional front elevation views of another metallic container being sealed with a threaded closure by an apparatus of another embodiment of the present invention.

In one embodiment, body 154 has a depth that is less a depth of a chamber 52 of the threaded closure 44. Accordingly, when the body 154 is positioned in the chamber 52, a lower end wall 134 of the body 154 may be spaced from a bottom portion 57 of the threaded closure when the apparatus 89C seals a metallic container 4 as generally illustrated in FIG. 9B. Alternatively, in another embodiment, the body 154 may have a depth that is approximately equal to, or greater than, the depth of the chamber 52 such that a lower end wall 134 of the body 154 can contact the bottom portion of the threaded closure similar to the operation of the apparatus 89A.

The flange 156 projects outwardly from the body 154. The flange is configured to apply a downward force to an extension 66 of the threaded closure 44. In one embodiment, the flange 156 has a cross-section that is tapered such that a thickness of the flange decreases as a distance from the body 154 increases. Specifically, in one embodiment, an inward portion of the flange proximate to the body 154 may have a thickness that is greater than a thickness of an outer portion of the flange.

In one embodiment, the flange 156 has a diameter that is at least equal to an interior diameter of the bore 12 of the metallic container. In another embodiment, the diameter of the flange 156 is at least equal to an exterior diameter of a curl 28 of the metallic container.

In operation, the capping tool 152B is brought into contact with the threaded closure 44 by the apparatus 89C. In one embodiment, the capping tool 152B can be moved along a longitudinal axis 92 of the metallic container 4 toward the threaded closure 44. Additionally, or alternatively, the metallic container 4 and threaded closure 44 may be moved along the longitudinal axis 92 toward the capping tool 152B. In one embodiment, the capping tool 152B applies a force of between approximately 10 pounds and approximately 300 pounds to the threaded closure 44. Optionally, the downward force applied by the capping tool 152B is approximately 100 pounds.

The capping tool 152B applies the force to a predetermined portion of the threaded closure 44. More specifically, in one embodiment, the capping tool 152B applies the force to a portion of the threaded closure that is inward of the neck portion 20 of the metallic container 4. In another embodiment, the force from the capping tool 152B is applied to a portion of the threaded closure inward the closure sidewall 67.

Figure 9A:
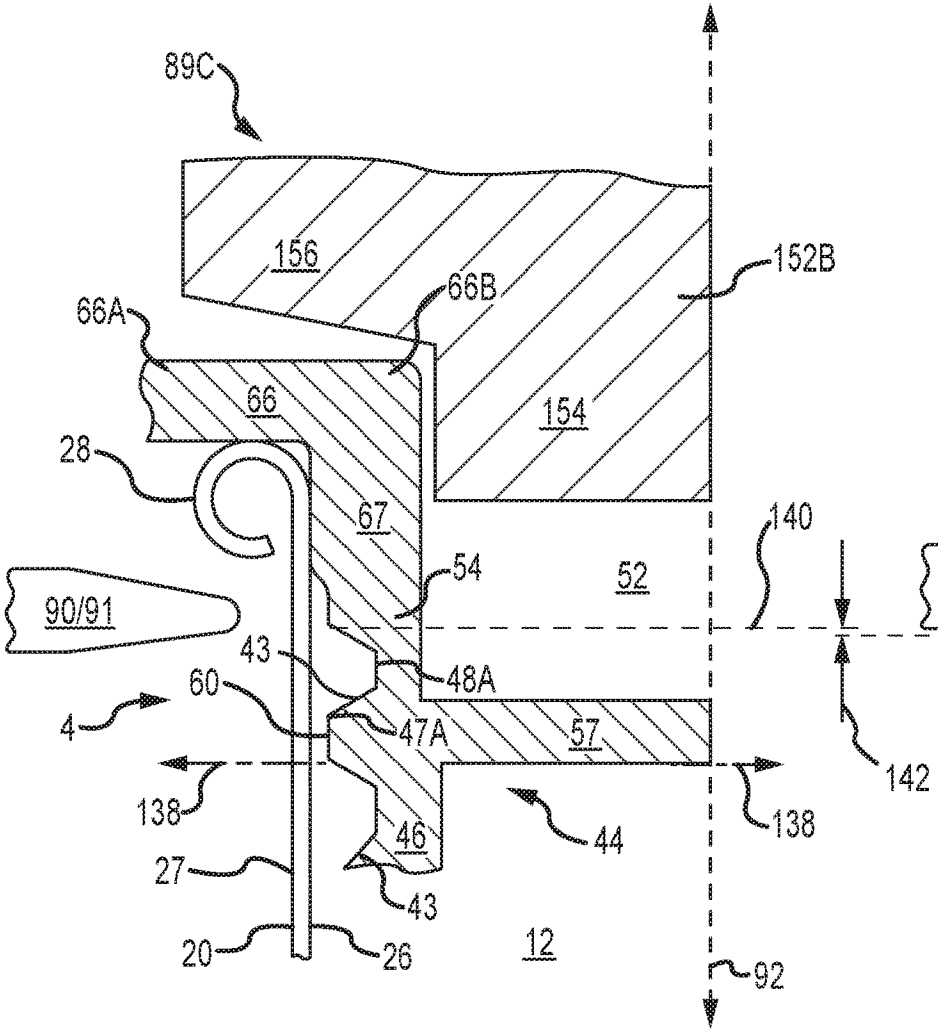

As the capping tool 152B contacts and applies the force to the extension 66, the closure threads 60 are pressed further into the container bore 12 away from the container curl 28 and toward a bottom 6 of the metallic container. The container bottom 6 may be the same as, or similar to, the container bottom 6 illustrated in FIG. 1 or 10A. More specifically, when the threaded closure 44 is initially positioned in the bore 12, a reference plane 140 through the closure threads 60 is in a first position spaced a predetermined distance from the container curl 28 as generally illustrated in FIG. 9A.

Referring now to FIG. 9B, in response to the downward force from the capping tool 152B, the closure threads and the reference plane 140 move further into the bore 12 from the curl 28 and closer to the container bottom 6. In this manner, the capping tool 152B places the threaded closure 44 in tension. When the capping tool 152B applies the force, the extension 66 may move into a concave orientation in one embodiment of the present invention, such as generally illustrated in FIG. 9B.

The position of the reference plane 140 moves by a distance 142 toward the container bottom 6 in response to the downward force received from the capping tool 152B. In one embodiment, the distance 142 is not more than approximately 0.050 inches. Optionally, in another embodiment, the distance 142 is between approximately 0.005 inches and approximately 0.10 inches, or approximately 0.020 inches. Optionally, the distance 142 is between approximately 0.005 inches and approximately 0.015 inches.

In another embodiment, the distance 142 is a predetermined fraction of the distance between adjacent peaks 47A of the closure threads 60. In one embodiment, the distance between adjacent thread peaks 47A defines a thread pitch of not more than 0.1 inches. Optionally, the thread pitch can be up to approximately 0.16 inches, or approximately 0.125 inches. In one embodiment, the thread peaks 47A are generally planar. Alternatively, in another embodiment, the thread peaks 47A can have a shape that is rounded or arcuate, such as generally illustrated in FIG. 6.

The extension 66 is prevented from moving into the container bore 12 by contact with a portion of the metallic container 4, such as the curl 28. In one embodiment, as the capping tool 152B applies the downward force to the threaded closure 44, the extension 66 is elastically deformed or flexed such that an outer portion 66A of the extension 66 can be further than the inner portion 66B of the extension from a plane 138 defined by the closure bottom 57, similar to the threaded closure illustrated in FIG. 6A.

In one embodiment, the force from the capping tool 152B alters an angle at which the extension 66 projects from the closure sidewall 67. More specifically, in one embodiment, the downward force from the capping tool 152B can increase the angle between extension outer portion 66A and the plane 138. In one embodiment, the downward force from the capping tool 152B alters the angle of the extension 66 by between approximately 0.5° and approximately 10°. In another embodiment, the downward force alters the angle by between approximately 3° and approximately 6°.

Another benefit of the downward force applied by the capping tool 152B is that a lower surface of the closure extension 66 can be pressed against an upper surface of the metallic container 4, such as the curl 28. The capping tool 152B can also maintain a predetermined radial or axial alignment between the threaded closure 44 and the metallic container 4 during formation of the container threads 42. In this manner, the capping tool 152B can beneficially maintain a predetermined fit between the closure threads 60 and the interior surface 26 of the container neck. For example, the capping tool 152B can maintain the threaded closure 44 and the metallic container 4 in a substantially coaxial alignment. More specifically, the downward force applied by the capping tool 152B can prevent unintended or inadvertent movement of the threaded closure 44 with respect to the metallic container 4, such as tipping or lateral movement of the threaded closure 44. This alignment improves the seal between the threaded closure and the metallic container.

In one embodiment, after the metallic container 4 has been sealed with the threaded closure 44, the threaded closure can be removed from the metallic container by applying between approximately 5 in-lbs and approximately 20 in-lbs, or approximately 15 in-lbs of torque to the threaded closure in an opening direction.

The apparatus 89C can form threads 42 (not illustrated in FIG. 9 for clarity) on the metallic container 4 while the capping tool 152 applies the downward force to the threaded closure 44. Accordingly, the container threads are formed while the closure threads 60 are in tension. The container threads can be formed by the apparatus 89C in a manner the same as, or similar to, apparatus 89 of all embodiments described herein.

In one embodiment, the apparatus 89C includes a tool 90, such as a thread roller 90 that is operable to form the container threads 42 by applying a force to an exterior surface 27 of a neck 20 of the metallic container. The thread roller 90 can press the neck portion against the closure threads 60 to form the container threads. In another embodiment, the apparatus 89C can form the container threads with any other method or tool described herein. When formed, in one embodiment the container threads substantially conform to the closure threads 60. In one embodiment, the container threads 42 formed by the apparatus 89C can optionally have the dimensions and features of the container threads 42 illustrated and described in conjunction with one or more of FIGS. 5, 6, and 7.

After the apparatus 89C has formed the container threads 42, the apparatus can separate the capping tool 152B from the threaded closure 44 to remove the downward force from the threaded closure. When the downward force is removed, the closure extension 66 can return at least partially to a shape similar to the shape illustrated in FIG. 9A. Specifically, the angle between the outer portion 66A of the closure extension 66 and the plane 138 can return at least partially to an initial angle generally illustrated in FIG. 9A. In one embodiment, the angle between the outer portion 66A and the plane 138 decreases when the downward force is removed. However, upper surfaces 43 of the closure threads 60 contact lower surfaces of the container threads 42 (such as generally illustrated in FIG. 7C). The contact between the closure threads 60 and the container threads 42 can apply a force to the container threads. In one embodiment, the closure threads 60 can apply up to approximately 45 pounds, or approximately 25 pounds of force to the container threads 42. In another embodiment, an upper surface 43 of the closure threads 60 can apply between approximately 1 pound and approximately 45 pounds of force to a lower surface 41 of the container threads 42 after the capping tool 152B is separated from contact with the metallic container 4. In another embodiment, the closure threads 60 may apply between approximately 1 pound and approximately 20 pounds of force to the container threads.

The force from the closure threads 60 creates tension in the closure body 46 and prevents the threaded closure from moving out of the bore 12 to the initial position generally illustrated in FIG. 9A. In one embodiment, after the metallic container 4 is sealed with the threaded closure 44, at least an upper portion 54 of the threaded closure will be in tension. In one embodiment, the upper portion 54 of the threaded closure which will be in tension is above an uppermost closure thread 60.

In one embodiment, the closure threads 60 move away from the container bottom 6 by not more than approximately one-half of the distance 142. More specifically, in one embodiment, the closure threads move between approximately 0.005 inches and approximately 0.05 inches toward the container curl 28 (or away from the container bottom 6) when the downward force from the capping tool 152B is removed. Additionally, or alternatively, in one embodiment, when the downward force from the capping tool 152B is removed, an upper portion of the metallic container, such as the curl 28, will be in contact with a portion of the threaded closure, such as the extension 66. After the downward force from the capping tool 152B is removed from the threaded closure 44, the capping apparatus 89C may release or eject the metallic container 4 with a product sealed therein.

Figure 10A:
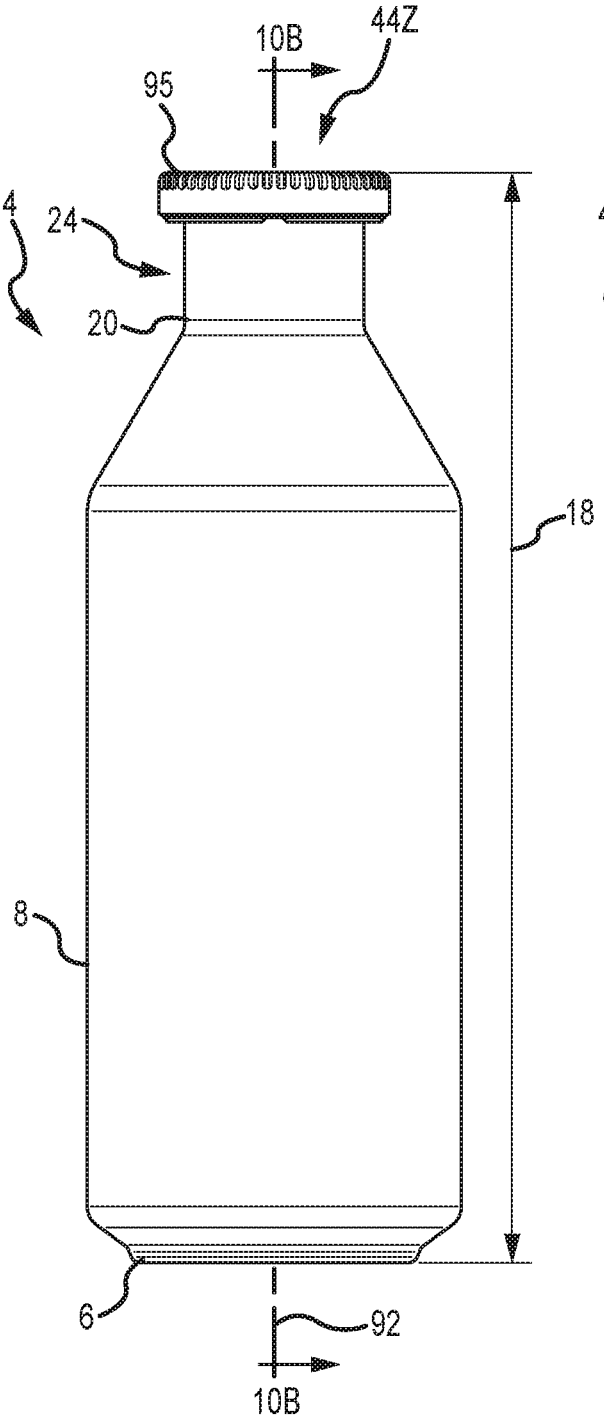
FIG. 10A is a front elevation view of a threaded closure positioned in an opening of a metallic container according to one embodiment of the present invention and showing the metallic container with an unthreaded neck prior to forming threads on the metallic container.
Figure 10B:
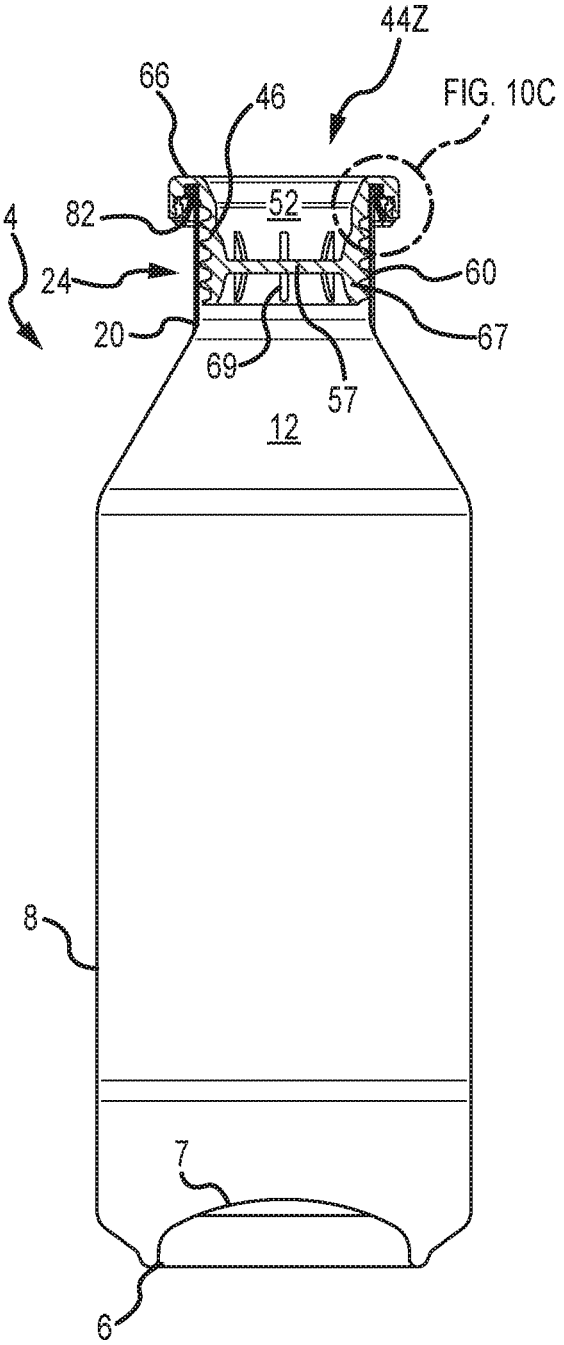
FIG. 10B is a cross-sectional front elevation view of the metallic container and threaded closure taken along line 10B-10B of FIG. 10A.
Figure 10C:
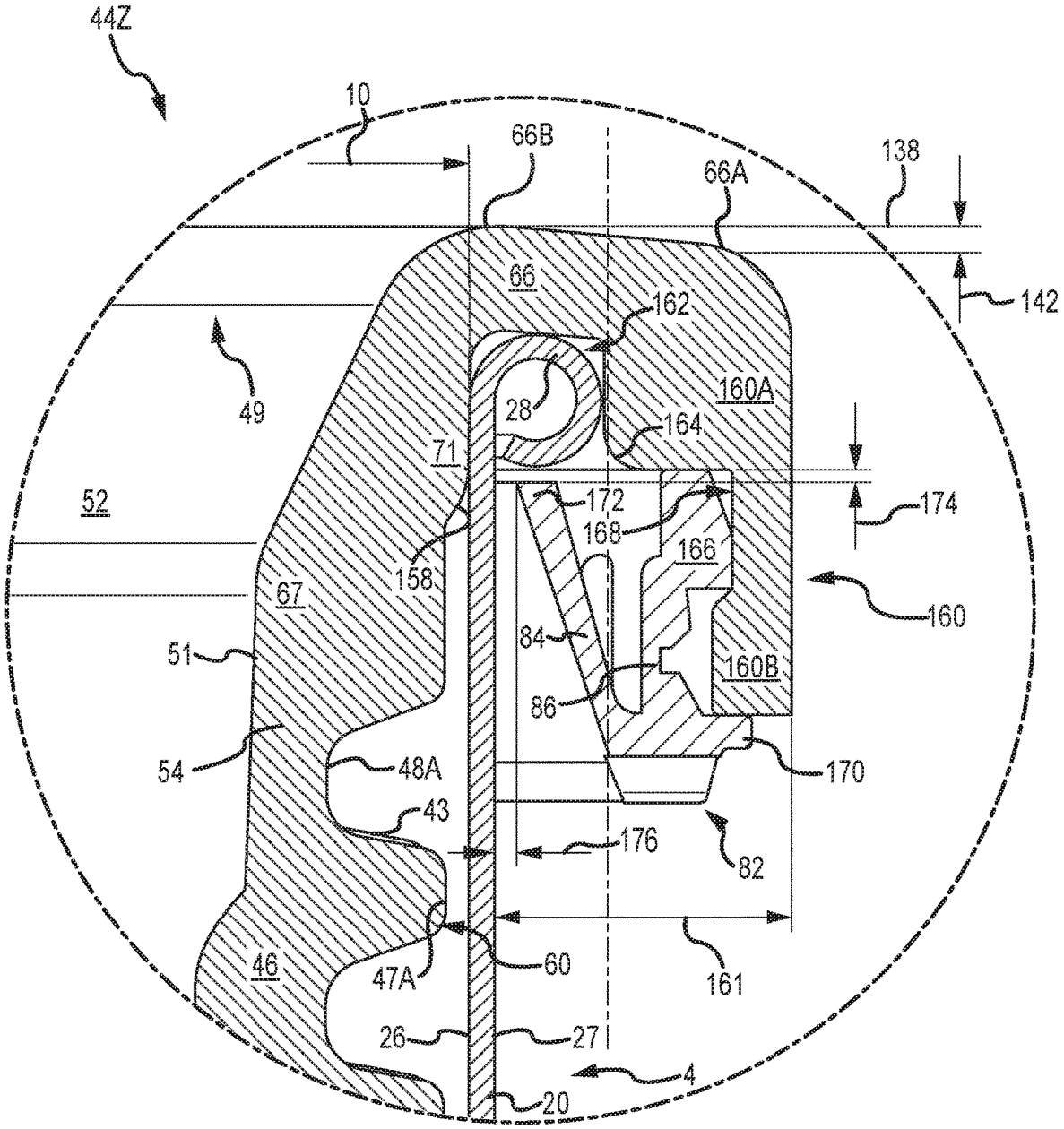
FIG. 10C is a detailed cross-sectional front elevation view of the metallic container and threaded closure of FIG. 10B.

Referring now to FIGS. 10A-10C, yet another embodiment of a metallic container 4 and a threaded closure 44Z of the present invention are generally illustrated. The metallic container 4 can be the same as or similar to other metallic containers described herein and generally includes a sidewall 8 extending between a bottom 6 and a neck 20 with a decreased diameter. As illustrated in FIG. 10B, in one embodiment the bottom 6 includes an inwardly oriented dome 7. The neck 20 is unthreaded when the threaded closure 44Z is initially positioned in an opening or bore 12 of the metallic container 4 as generally illustrated in FIGS. 10A-10B. Threads may subsequently be formed on a thread region 24 of the neck 20 using the apparatus 89 and methods described herein. The neck 20 may optionally include a curl 28.

In one embodiment, the metallic container 4 with the threaded closure 44Z has a height 18 of between approximately 7.2 inches and approximately 8.0 inches, or between approximately 7.5 inches and approximately 7.7 inches. As illustrated in FIG. 10C, in one embodiment the neck 20 of the metallic container 4 has an interior diameter 10 of between approximately 0.9 inches and approximately 1.5 inches, or between approximately 1.10 inches and approximately 1.32 inches.

The threaded closure 44Z can include many features that are the same as, or similar to, the threaded closure 44Y described in conjunction with FIG. 8. The threaded closure 44Z can be formed of a plastic or a metal. In one embodiment, the threaded closure 44Z is formed of injection molded plastic.

The threaded closure 44Z generally includes a body 46. A chamber 52 can optionally be formed in the body 46. The chamber 52 is generally defined by a bottom 57, an interior surface 51 of a sidewall 67, and an opening 49. The sidewall 67 may be angled relative to the longitudinal axis 92 such that the chamber has a diameter that decreases proximate to the bottom 57. Buttresses 69 may optionally be formed between the bottom 57 and the sidewall 67. In one embodiment, the sidewall 67 extends below the bottom 57.

Closure threads 60 are formed on an exterior surface of the closure sidewall. The closure threads 60 can have any geometry and configuration described herein. The closure threads generally include peaks 47A and valleys 48A. In one embodiment, a distance between adjacent peaks 47A (or the thread pitch) is up to approximately 0.1 inches. Alternatively, the thread pitch can be up to approximately 0.16 inches. Optionally, the peaks 47A can be generally planar. Alternatively, in another embodiment, the peaks have a shape that is rounded or generally arcuate as generally illustrated in FIG. 5.

The threaded closure 44Z can include an extension 66 that projects outwardly from the sidewall 67. Similar to the threaded closure 44Y, in one embodiment an upper surface of the extension 66 is not perpendicular to the longitudinal axis 92. Accordingly, an outer portion 66A of the extension 66 can be spaced from a plane 138 which is perpendicular to the longitudinal axis and that intersects an inner portion 66B of the extension. In one embodiment, the outer portion 66A is separated from the plane 138 by a distance 142 of between approximately 0.010 inches and approximately 0.10 inches. In another embodiment, the distance 142 can be a predetermined fraction of the distance between adjacent peaks 47A of the closure threads 60.

Referring now to FIG. 10C, in one embodiment the threaded closure 44Z does not include a plug seal 72 such as illustrated in FIG. 8. Instead, the threaded closure 44Z has a projection 71 extending outwardly from the sidewall 67. The projection 71 is adapted to form a seal with an interior surface 26 of the container neck 20. More specifically, the projection 71 can have a geometry configured to form an interference fit with the container interior surface 26. Beneficially, the projection 71 can be formed with the threaded closure 44Z in a mold that includes fewer interior spaces than are required to form a plug seal 72.

The projection 71 can optionally include a lower surface 158 adapted to engage an upper portion of the metallic container 4, such as a curl 28, to guide or orient the projection 71 relative to the bore 12 of the metallic container 4. In one embodiment, the lower surface 158 is tapered. In another embodiment, the lower surface has a predetermined radius of curvature.

In one embodiment, the projection 71 has an exterior diameter approximately equal to the interior diameter 10 of the container neck. Optionally, the exterior diameter of the projection 71 is between approximately 0.9 inches and approximately 1.5 inches, or between approximately 1.10 inches and approximately 1.32 inches.

The outer portion 66A of the extension 66 projects downwardly to define a skirt 160. In one embodiment, the skirt 160 generally includes an upper portion 160A and a lower portion 160B. In one embodiment, the upper portion 160A is thicker than the lower portion 160B. An exterior surface of the skirt 160 can be spaced a predetermined distance 161 from the exterior surface 27 of the container neck 20. The distance 161 may be between approximately 0.10 inches and approximately 0.30 inches in one embodiment of the present invention.

In one embodiment, the lower portion 160B of the skirt 160 does not extend below an uppermost portion of the closure threads 60 as generally illustrated in FIG. 10C. Accordingly, when the threaded closure 44Z is positioned within a bore of a metallic container 4 of the present invention, threads may be formed on a neck 20 of the metallic container 4 by applying a force to the neck to press the metallic container against the closure threads 60 without interference from the skirt 160.

Optionally, a recess 162 can be formed in the extension 66. The recess 162 is generally adapted to receive at least a portion of the curl 28 of the metallic container. In one embodiment, the recess 162 extends between an outer surface of the projection 71 and an interior surface of the skirt upper portion 160A. A lower surface 164 of the upper skirt 160A may have a shape adapted to guide or orient the threaded closure into a predetermined orientation relative to the curl 28 when the threaded closure 44Z is positioned within the bore of the metallic container 4. In one embodiment, the lower surface 164 is tapered or rounded with a predetermined radius of curvature. One benefit of the projection 71 and recess 162 are that they can help align the metallic container 4 and the threaded closure 44Z such that, for example, the metallic container and threaded closure can be substantially concentrically aligned. Additionally, the projection 71 and recess 162 can eliminate or reduce inadvertent or unintended movement or pivoting of the threaded closure when threads are formed on the metallic container.

The skirt 160 is configured to retain a tamper indicator 82. In one embodiment, the tamper indicator 82 is formed separately from the threaded closure 44Z. More specifically, the tamper indicator 82 can be interconnected to the threaded closure 44Z or to the threaded closure 44Y described in conjunction with FIG. 8. In one embodiment, the tamper indicator 82 can one or more of frictionally and mechanically engage the threaded closure 44Z. Additionally, or alternatively, the tamper indicator 82 can snap into engagement with the threaded closure 44Z. Optionally, the tamper indicator 82 is formed of a plastic. In one embodiment, the tamper indicator is injection molded.

When the tamper indicator 82 is formed separately from the threaded closure 44Z, the tamper indicator can be formed of a different material than the threaded closure 44Z. By forming the tamper indicator separately, the tamper indicator 82 can beneficially be formed of a material with different properties, or that is less expensive, than the material used to form the threaded closure. In one embodiment, the tamper indicator 82 can be formed of a material selected to fracture or break more easily than the material of the threaded closure. Additionally, a form used to injection mold the threaded closure 44Z can be less complex, and easier to fabricate, by separately forming the tamper indicator. Further, removing a threaded closure 44Z including an integral tamper indicator 82 from a mold may be a challenge and could result in damage to the threaded closure or the mold.

The tamper indicator 82 may include a hook or catch 166 configured to engage a groove 168 of the extension 66. The catch 166 can extend continuously around the tamper indicator 82. Alternatively, in another embodiment, the catch 166 may be intermittently formed on the tamper indicator. For example, a plurality of individual catches 166 can be spaced around the tamper indicator.

In one embodiment, the groove 168 can be formed in the lower portion 160B of the skirt. Optionally, the groove 168 may extend continuously around an interior circumference of the lower portion 160B. In another embodiment, the groove 168 can be periodically formed in separate portions of the skirt lower portion. Accordingly, the lower portion 160B may include a first groove 168 spaced from two adjacent grooves 168.

Optionally, the tamper indicator 82 can include a flange 170 that projects outwardly. In one embodiment, the flange 170 is configured to frictionally engage the lower portion 160B of the skirt. More specifically, in one embodiment the flange 170 is configured to contact a free end of the skirt lower portion 160B. In another embodiment, the flange 170 has an outer diameter that is not greater than an outer diameter of the skirt 160.

An extension 84 extends inwardly from the tamper indicator 82. The extension 84 is not parallel to the longitudinal axis 92. In one embodiment, a free end 172 of the extension 84 is angled toward the longitudinal axis 92. When the threaded closure 44Z is positioned within the bore 12 of the metallic container, the extension 84 can bend or flex away from the longitudinal axis 92 to enable the curl 28 to move between the extension 84 and the exterior surface of the threaded closure until the curl 28 is positioned at least partially within the recess 162. However, the free end 172 of the extension 84 has an interior diameter that is less than an exterior diameter of the curl 28 of the metallic container. Accordingly, when the threaded closure 44Z is subsequently moved upwardly to open the metallic container, the extension 84 of the tamper indicator 82 can contact a bottom surface of the curl 28, or another surface formed on the neck 20 of the metallic container, preventing the tamper indicator 82 from sliding back over the curl 28. If the threaded closure 44Z is moved further upwardly, a force is applied to the extension 84. The force releases the hook 166 from the groove 168. In one embodiment, the force can push the flange 170 outwardly and causes the hook 166 to pivot inwardly away from the closure groove 168. In this manner, the tamper indicator 82 is released from the threaded closure 44Z and is retained on the neck 20 of the metallic container 4. The presence of the tamper indicator 82 on the neck 20 of the metallic container provides a visual indication to a consumer that the closure 44Z has been at least partially opened or unthreaded and the seal to the metallic container 4 compromised.

The free end 172 of the extension 84 can be spaced from the curl 28 by a predetermined distance 174. In one embodiment, the distance 174 is between approximately 0.005 inch and approximately 0.015 inch. In another embodiment, the free end 172 is also separated from the exterior surface 27 of the metallic container by a predetermined distance 176. The distance 176 may optionally be between approximately 0.01 inches and approximately 0.02 inches. The spacing between the curl 28 and the extension free end 172 may beneficial prevent inadvertent or unintended separation of the tamper indicator 82 from the threaded closure 44Z, for example, if the metallic container 4 or the threaded closure are dropped or bumped.

In one embodiment, the tamper indicator 82 includes an area of weakness 86. The area of weakness 86 may be a scored or serrated band 86. Additionally, or alternatively, the area of weakness 86 can be formed or molded to have a width that is less than other portions of the tamper indicator. In one embodiment, the area of weakness 86 is formed between the hook 166 and the flange 170. When the threaded closure 44Z is moved away from the container bottom 6, the extension 84 contacts the curl 28 and transmits a force to the area of weakness. The force tears the area of weakness or fractures the score or serrated band of the area of weakness 86 to separate the hook 166 from the flange 170. In this manner, at least the flange 170 is retained on the neck 20 of the metallic container.

After the threaded closure 44Z is positioned in the bore 12 of the metallic container as generally illustrated in FIG. 10B, an apparatus 89 of the present invention can form threads on the container neck 20 as described herein. In one embodiment, the container threads 42 can be formed by apparatus 89 illustrated in FIG. 5.

Alternatively, the container threads 42 can be formed by an apparatus 89A, 89B, 89C that places the threaded closure 44Z in tension or elastically deforms the threaded closure before forming the container threads 42. For example, in one embodiment, apparatus 89A can apply a downward force to the closure bottom 57 with an interior tool 132. The apparatus 89A may subsequently form threads on the metallic container 4 while the threaded closure 44Z is in tension. The apparatus 89B can also be used to form container threads 42 on the metallic container 4 while applying a downward force to the threaded closure 44Z. In another embodiment, the apparatus 89C can place the threaded closure 44Z in tension or elastically deform the threaded closure by applying a downward force to the threaded closure with a capping tool 152B. After the container threads 42 are formed on the metallic container 4, the downward force can be released or removed from the threaded closure and a product is sealed in the metallic container 4. In one embodiment, the upper surface 43 of the closure threads 60 apply an upward force to the container threads 42. Accordingly, at least a portion of the threaded closure 44Z will be in tension due to the upward movement of the closure threads 60 being restricted by contact with the container threads 42. In one embodiment, at least an upper portion 54 of the closure body 46 will be in tension after the container threads 42 are formed.

Although various aspects and embodiments of the present invention have been described with respect to metallic containers, the present invention is not limited to use with metallic containers and can be practiced with containers formed of any material and having any desired size or shape. For example, portions of the metallic containers and/or the threaded closures may be formed of plastic, glass, paper, or metal. Further, the apparatus 89 of all embodiments of the present invention may be used to form threads on a container formed of any material, including without limitation plastic, glass, paper, or metal, and combinations thereof.

The present invention has many benefits compared to prior art bottles and closures. Metallic containers 4 and threaded closures 44 of the present invention are less expensive to produce than bottles or other containers with external threads. The threaded closure 44 of the present invention has increased resistance to pressure induced blowout and leakage than closures that engage external threads of a metallic container. Therefore, a metallic container 4 sealed with a closure 44 of the present invention may have a larger neck diameter 10 for a given internal pressure than is possible with known metallic containers and closures that engage external container threads. Larger diameter necks can provide a faster product dispense rate and a better pour of a product from the container without glugging, resulting in a more enjoyable experience for the consumer. The threaded closures of the present invention may have thread channels to release pressure from within the metallic container while the closure threads are still engaged with the container threads, preventing pressure induced blowout of the closure. In addition, consumers can use the threaded closures 44 to reclose and/or reseal metallic containers 4 decreasing the amount of product lost due to spoilage and spills. The metallic containers 4 of the present invention are also lighter and more durable than glass bottles. Finally, threaded closures 44 of the present invention provide a novel internal chamber 52 that can be sealed and used to store optional contents. In one embodiment, the internal chamber 52 can be used to store a product within the metallic container 4.

The description of the present invention has been presented for purposes of illustration and description, but is not intended to be exhaustive or limiting of the invention to the form disclosed. Many modifications and variations will be apparent to those of ordinary skill in the art. The embodiments described and shown in the figures were chosen and described in order to best explain the principles of the invention, the practical application, and to enable those of ordinary skill in the art to understand the invention.

While various embodiments of the present invention have been described in detail, it is apparent that modifications and alterations of those embodiments will occur to those skilled in the art. Moreover, references made herein to "the present invention" or aspects thereof should be understood to mean certain embodiments of the present invention and should not necessarily be construed as limiting all embodiments to a particular description. It is to be expressly understood that such modifications and alterations are within the scope and spirit of the present invention, as set forth in the following claims.

What is claimed is:

1. An apparatus to seal a metallic container with a threaded closure inserted into an opening of the metallic container, comprising:

a first tool configured to apply a first force to the threaded closure positioned in the opening of the metallic container, the first force directed downwardly relative to a longitudinal axis of the metallic container, wherein a lower surface of the first tool that is adjacent to the threaded closure is generally planar;

wherein the threaded closure includes a closure body, an outer surface including closure threads, and an extension projecting outwardly from an upper end of the closure body at a first angle relative to the longitudinal axis;

wherein the metallic container includes a bottom portion, a sidewall portion, a neck extending upwardly from the sidewall portion, the neck being unthreaded, a curl formed at an uppermost end of the neck, and the opening positioned opposite to the bottom portion;

wherein the first tool is configured to initially contact an uppermost area of the threaded closure positioned between opposing portions of the curl of the metallic container; and wherein the first force from the first tool is configured to elastically deform the threaded closure and alter the first angle at which the extension projects from the closure body; and a second tool configured to apply a second force to an exterior surface of the neck of the metallic container to form container threads on the neck by pressing the neck against the closure threads, wherein the second tool is configured to apply the second force while the first tool applies the first force, and wherein the threaded closure is biased in an upward direction after the second tool forms the container threads.

2. The apparatus of claim 1, wherein the second tool comprises a thread roller that is configured to apply the second force generally transverse to the longitudinal axis of the metallic container, wherein the thread roller is configured to form container threads that include peaks that project inwardly from an interior surface of the neck and inwardly oriented valleys on the exterior surface of the neck, the valleys corresponding to the peaks.

3. The apparatus of claim 1, wherein the first tool is configured to move downwardly between approximately 0.005 inches and 0.1 inches after initially contacting the threaded closure.

4. The apparatus of claim 1, wherein the first force applied to the threaded closure by the first tool is between approximately 1 pound and approximately 300 pounds, and wherein the first tool is configured to apply the first force to the extension projecting from the closure body.

5. The apparatus of claim 1, wherein movement of the first and second tools and timing of application of the first and second forces are configured to be controlled by cams that engage cam followers of the apparatus.

6. The apparatus of claim 1, wherein an upper surface of the extension of the threaded closure projects toward a bottom portion of the closure body, and wherein the first force is configured to bend the extension upwardly and away from the bottom portion.

7. The apparatus of claim 6, wherein the first force is configured to deflect the extension such that the upper surface of the extension is approximately parallel to a reference plane that is perpendicular to the longitudinal axis.

8. The apparatus of claim 1, wherein the apparatus is configured such that, after the second tool forms the container threads, the first tool is retracted from the threaded closure such that the closure threads move upwardly away from the bottom portion of the metallic container and apply a force to the container threads thereby placing the closure body of the threaded closure in tension.

9. The apparatus of claim 1, wherein the first tool is configured to move relative to the threaded closure and the metallic container such that:

in a first position of the first tool the first tool is in contact with the threaded closure, a lower portion of the extension is in contact with the curl, and an upper portion of the closure threads is a first distance from the bottom portion of the metallic container, and in a second position of the first tool the first tool is a distance $\Delta Y$ closer to the bottom portion of the metallic container and the upper portion of the closure threads is a second distance from the bottom portion of the metallic container, the second distance being less than the first distance.

10. The apparatus of claim 9, wherein the distance $\Delta Y$ is between approximately 0.005 inches and 0.1 inches.

11. The apparatus of claim 9, wherein after the container threads are formed, the first tool is configured to move away from the metallic container out of contact with the threaded closure to permit the upper portion of the closure threads to move away from the bottom portion of the metallic container to a position a third distance from the bottom portion of the metallic container, the third distance being between the first and second distances.

12. The apparatus of claim 1, wherein the first angle is a first oblique angle relative to a reference plane that is orthogonal to the longitudinal axis of the metallic container.

13. The apparatus of claim 12, wherein the first force is configured to alter the first angle such that an upper surface of the extension projects approximately parallel to the reference plane.

* * * * *